US010870135B2

(12) United States Patent
Raasch et al.

(10) Patent No.: US 10,870,135 B2
(45) Date of Patent: Dec. 22, 2020

(54) PRESSURE WASHERS INCLUDING JET PUMPS

(71) Applicant: Briggs & Stratton Corporation, Wauwatosa, WI (US)

(72) Inventors: Jason J. Raasch, Cedarburg, WI (US); Joseph Giacalone, Hartland, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 325 days.

(21) Appl. No.: 15/532,796

(22) PCT Filed: Dec. 2, 2015

(86) PCT No.: PCT/US2015/063487
§ 371 (c)(1),
(2) Date: Jun. 2, 2017

(87) PCT Pub. No.: WO2016/090029
PCT Pub. Date: Jun. 9, 2016

(65) Prior Publication Data

US 2017/0361357 A1 Dec. 21, 2017

Related U.S. Application Data

(60) Provisional application No. 62/088,426, filed on Dec. 5, 2014.

(51) Int. Cl.
*B05B 7/04* (2006.01)
*B08B 3/02* (2006.01)
(Continued)

(52) U.S. Cl.
CPC ..... *B08B 3/026* (2013.01); *B01F 3/088* (2013.01); *B01F 3/0865* (2013.01); *B01F 5/043* (2013.01);
(Continued)

(58) Field of Classification Search
CPC ..... B08B 3/026; B08B 3/02; B01F 3/0865; B01F 3/088; B01F 5/0428; B01F 5/043;
(Continued)

(56) References Cited

U.S. PATENT DOCUMENTS 828,705 A 8/1906 Bode
1,262,539 A 8/1906 Bode
(Continued)

FOREIGN PATENT DOCUMENTS

CH 696692 A5 9/2007
CN 101450345 A 6/2009
(Continued)

OTHER PUBLICATIONS

6×6 Jet Pump Brochure, Offshore Cleaning Systems, 2011, 4 pages.
(Continued)

*Primary Examiner* — Tuongminh N Pham
(74) *Attorney, Agent, or Firm* — Foley & Lardner LLP

(57) ABSTRACT

A pressure washer includes a pump for pressurizing a primary fluid flow, the pump including a pump inlet for receiving fluid from a common fluid source and a pump outlet for supplying a pressurized primary fluid and a jet pump including a primary fluid inlet fluidly coupled to the pump outlet, a secondary fluid inlet configured to receive fluid from the common fluid source, and a fluid outlet. In a high pressure operating mode, all of the pressurized primary fluid flows through the jet pump and exits through the fluid outlet of the jet pump. In a high flow operating mode, all the pressurized primary fluid flows through the jet pump and entrains a secondary fluid supplied through the secondary fluid inlet from the common fluid source so that the secondary fluid also flows through the jet pump, resulting in a combined fluid flow of the primary fluid and the secondary fluid that exits through the fluid outlet of the jet pump.

17 Claims, 22 Drawing Sheets

(51) Int. Cl.

| | |
|---|---|
| ***B01F 5/04*** | (2006.01) |
| ***B01F 13/00*** | (2006.01) |
| ***B01F 3/08*** | (2006.01) |
| *F04F 5/00* | (2006.01) |

(52) U.S. Cl.
CPC ..... *B01F 5/0423* (2013.01); *B01F 5/0428* (2013.01); *B01F 5/0496* (2013.01); *B01F 5/0498* (2013.01); *B01F 13/0027* (2013.01); *B08B 3/02* (2013.01); *B05B 7/0408* (2013.01); *B08B 2203/027* (2013.01); *B08B 2203/0217* (2013.01); *F04F 5/00* (2013.01)

(58) Field of Classification Search
CPC .... B01F 5/0423; B01F 5/0496; B01F 5/0498; B01F 13/0027; B01F 5/0413; B05B 7/0408
See application file for complete search history.

(56) References Cited

U.S. PATENT DOCUMENTS

| | | | | |
|---|---|---|---|---|
| 1,369,567 | A | | 2/1921 | Smith |
| 2,678,457 | A | | 1/1950 | Demo et al. |
| 2,540,240 | A | | 2/1951 | Boyle |
| 3,030,890 | A | | 4/1962 | Galik |
| 3,114,164 | A | | 12/1963 | Riordan |
| 3,181,797 | A | * | 5/1965 | Hayes ..... A01C 23/042 239/317 |
| 3,283,352 | A | | 11/1966 | Hu |
| 3,377,028 | A | | 4/1968 | Bruggeman |
| 3,383,044 | A | | 5/1968 | Norstrud et al. |
| 3,748,678 | A | | 7/1973 | Ballou |
| 3,829,024 | A | | 8/1974 | Heden |
| 4,084,281 | A | | 4/1978 | Smith |
| 4,089,079 | A | | 5/1978 | Nicholson |
| 4,135,860 | A | | 1/1979 | Van Nederkassel |
| 4,207,640 | A | | 6/1980 | Sekula et al. |
| 4,227,862 | A | | 10/1980 | Andrew et al. |
| 4,238,074 | A | | 12/1980 | Coons |
| 4,249,282 | A | | 2/1981 | Little |
| 4,373,444 | A | | 2/1983 | Cunnington |
| 4,387,850 | A | | 6/1983 | Gerber |
| 4,417,826 | A | | 11/1983 | Floros |
| 4,461,052 | A | | 7/1984 | Mostul |
| 4,507,053 | A | | 3/1985 | Frizzell |
| 4,513,466 | A | | 4/1985 | Keddie et al. |
| 4,532,666 | A | | 8/1985 | Smyth |
| 4,763,373 | A | | 8/1988 | Sanchez |
| 4,781,537 | A | | 11/1988 | Nicodemus et al. |
| 4,856,133 | A | | 8/1989 | Sanchez |
| 5,007,127 | A | | 4/1991 | Paolo |
| 5,029,758 | A | | 7/1991 | Chayer |
| 5,086,975 | A | | 2/1992 | Paige |
| 5,129,121 | A | | 7/1992 | Gelman |
| 5,238,191 | A | | 8/1993 | Gaymon |
| 5,395,052 | A | | 3/1995 | Schneider et al. |
| 5,421,520 | A | | 6/1995 | Simonette et al. |
| 5,529,460 | A | | 6/1996 | Eihusen et al. |
| 5,619,766 | A | | 4/1997 | Zhadanov et al. |
| 5,649,334 | A | | 7/1997 | Henriquez et al. |
| 5,741,124 | A | | 4/1998 | Mazzucato et al. |
| 5,911,256 | A | | 6/1999 | Tsai |
| 5,913,982 | A | | 6/1999 | Phillips |
| 5,975,423 | A | | 11/1999 | Rice et al. |
| 6,021,539 | A | | 2/2000 | Zhadanov et al. |
| 6,164,496 | A | | 12/2000 | Gregory |
| 6,189,811 | B1 | | 2/2001 | Rudy |
| 6,561,481 | B1 | | 5/2003 | Filonczuk |
| 6,571,805 | B2 | | 6/2003 | Hoenisch et al. |
| 6,687,924 | B2 | | 2/2004 | Wright et al. |
| 6,688,855 | B2 | | 2/2004 | Beckerman |
| 6,857,444 | B2 | | 2/2005 | Davis |
| 6,892,957 | B2 | | 5/2005 | Bennett et al. |
| 6,913,221 | B2 | | 7/2005 | Moon et al. |
| 6,915,541 | B2 | | 7/2005 | Alexander |
| 6,921,060 | B2 | | 7/2005 | Weed, Jr. |
| 7,017,603 | B1 | | 3/2006 | Rosine et al. |
| 7,080,953 | B2 | | 7/2006 | Delaine, Jr. |
| 7,083,120 | B2 | | 8/2006 | Gilpatrick et al. |
| 7,217,053 | B2 | | 5/2007 | Alexander et al. |
| 7,222,644 | B2 | | 5/2007 | Pianetto et al. |
| 7,281,903 | B2 | | 10/2007 | Reverberi et al. |
| 7,316,368 | B2 | | 1/2008 | Moon et al. |
| 7,389,949 | B2 | | 6/2008 | Marchand et al. |
| 7,472,842 | B2 | | 1/2009 | Gilpatrick et al. |
| 7,762,787 | B2 | | 7/2010 | Kawakami et al. |
| 8,444,068 | B2 | | 5/2013 | Hahn et al. |
| 2004/0131473 | A1 | | 7/2004 | Lanfredi et al. |
| 2004/0231723 | A1 | | 11/2004 | Harrington et al. |
| 2005/0013708 | A1 | | 1/2005 | Peeler et al. |
| 2005/0017117 | A1 | | 1/2005 | Moon et al. |
| 2005/0161538 | A1 | | 7/2005 | Cattaneo et al. |
| 2005/0164554 | A1 | | 7/2005 | Cattaneo et al. |
| 2005/0241685 | A1 | | 11/2005 | Findley |
| 2006/0045752 | A1 | | 3/2006 | Beckman |
| 2006/0083634 | A1 | | 4/2006 | Dexter et al. |
| 2006/0110265 | A1 | | 5/2006 | Lanfredi et al. |
| 2006/0245941 | A1 | | 11/2006 | Sharp |
| 2007/0113368 | A1 | | 5/2007 | Alexander |
| 2007/0114319 | A1 | | 5/2007 | Anderson et al. |
| 2007/0125878 | A1 | | 6/2007 | Hahn et al. |
| 2007/0267063 | A1 | | 11/2007 | Davis |
| 2008/0014096 | A1 | | 1/2008 | Gilpatrick |
| 2008/0050246 | A1 | | 2/2008 | Bevington |
| 2008/0061167 | A1 | | 3/2008 | Gansebom |
| 2008/0083077 | A1 | | 4/2008 | Alexander et al. |
| 2008/0245425 | A1 | | 10/2008 | Alexander |
| 2008/0300727 | A1 | | 12/2008 | Zarowny et al. |
| 2009/0269218 | A1 | | 10/2009 | Gardner et al. |
| 2010/0243086 | A1 | | 9/2010 | Gilpatrick |
| 2011/0005024 | A1 | | 1/2011 | Spitler et al. |
| 2011/0274570 | A1 | | 11/2011 | Groeger et al. |
| 2012/0006431 | A1 | | 1/2012 | Gilpatrick |
| 2013/0214059 | A1 | | 8/2013 | Gilpatrick et al. |
| 2013/0216402 | A1 | | 8/2013 | Raasch et al. |
| 2014/0246517 | A1 | | 9/2014 | Raasch |

FOREIGN PATENT DOCUMENTS

| | | | |
|---|---|---|---|
| CN | 101817005 | A | 9/2010 |
| DE | 88 14 243 | U1 | 2/1989 |
| DE | 38 40 787 | A1 | 6/1990 |
| DE | 39 36 689 | | 7/1990 |
| DE | 19548497 | C1 | 4/1997 |
| DE | 29908357 | U1 | 8/2000 |
| EP | 0 783 923 | A1 | 7/1997 |
| EP | 1 897 620 | A2 | 3/2008 |
| GB | 2 225 612 | | 6/1990 |
| JP | 07-252879 | | 10/1995 |
| JP | H07-252879 | A | 10/1995 |
| JP | 2000-304000 | A | 10/2000 |

OTHER PUBLICATIONS

AZ Sludge Hog Brochure and Drawings, undated, http://www.cccmix.com/az-sludge-hog/ retrieved on Dec. 5, 2012, 3 pages.
Blair et al., Special Investigation: Design of an Intake Bellmouth, 4 pages.
Ejectors & Ejector Theory, Aug. 2002, 4 pages.
Ejectors and Jet Pumps Design and Performance for Incompressible Liquid Flow, IHS, Mar. 2007, 104 pages.
Electric Jet Pump Pressure Washers Problems & Solutions, http://www.fixya.com/tags/jet_pump/pressure_washers/electric, retrieved on Jul. 2, 2013, 6 pages.
Energy Tips-Pumping Systems, Pumping Systems Tip Sheet #12, Control Strategies for Centrifugal Pumps with Variable Flow Rate Requirements, U.S. Department of Energy, May 2007, 2 pages.
Flotec 3/4 HP Thermoplastic Shallow-Well Jet Pump, http://www.homedepot.com/p/Flotec-3-4-HP-Thermoplastic-Shallow-Well-Jet-Pump-FP4022/100212883#.UVs_1aJwfTo, retrieved on Jul. 2, 2013, 2 pages.

(56) References Cited

OTHER PUBLICATIONS

Garden Hose Centrifugal Pump | BIC Superstore, Flint Walling/Star HPP360 Garden Hose Centrifugal Pump, printed on Jan. 6, 2009, from Internet address: http://www.bicsuperstore.com/Garden-Hose-Centrifugal-Pump/M/B000DZKZ02.htm, 3 pages.
Garden Hose Comfort Grip Nozzle 7 Pattern #594 by Gilmour Manufacturing, http://www.hardwareandtools.com/invt/3774379, retrieved on Jan. 6, 2009, 4 pages.
Gauges, Water Pumps, and Flow Meters from Premium Water Filters, Premium Water Filters, printed on Jan. 6, 2009, from Internet address: http://www.premium-water-filters.com/gauges-pumps.htm, 12 pages.
Homelite Hydrosurge 1700 PSI Electric Pressure Washer, published May 30, 2012, author: The Home Depot, 2 pages, available at http://www.youtube.com/watch?v=SEEay2Qtxc0.
International Search Report and Written Opinion for PCT Application No. PCT/US15/63487, dated Jan. 29, 2016, 12 pages.
International Search Report and Written Opinion for PCT Application No. PCT/US2013/052001, dated May 9, 2014, 26 pages.
Lisowski et al., CFD Modelling of a Jet Pump with Circumferential Nozzles for Large Flow Rates, Archives of Foundry Engineering, Mar. 2010, 4 pages.
PowerCare Pump-n-Vac Attachment Video, published Jun. 12, 2012, author; Home Depot, available at http://www.youtube.com/watch?v=jv9zazxIRzw, 2 pages.
Roto-Jet Pump Brochure, Weir Specialty Pumps, 2009, 2 pages.
Sanger, Cavitating Performance of Two Low-Area-Ratio Water Jet Pumps Having Throat Lengths of 7.25 Diameters, May 1968, 42 pages.
Stolyarov, A Way of Increasing the Efficiency of Liquid Ejectors, Prikladnaya Mekhanika, Oct. 9, 1965, 2 pages.
Watanawanavet, CFD Optimization Study of High-Efficiency Jet Ejectors, May 2008, 300 pages.
Watanawanavet, Optimization of a High-Efficiency Jet Ejector by Using Computational Fluid Dynamic (CFD) Software, May 2008, 54 pages.

* cited by examiner

PRESSURE WASHERS INCLUDING JET PUMPS

CROSS-REFERENCE TO RELATED PATENT APPLICATIONS

This application claims the benefit of U.S. Provisional Application No. 62/088,426, filed Dec. 5, 2014, which is incorporated herein by reference in its entirety.

BACKGROUND

The present invention relates generally to a device that pressurizes and sprays water, such as for outdoor cleaning applications. More specifically, the present invention relates to a device that is configured to condition the flow of water, such as by changing the flow rate, the water pressure, the shape of the flow exiting the device, or other characteristics of the flow, in order to customize performance of the device to one of a variety of outdoor cleaning tasks.

Different water spraying devices are used for different applications. Garden hose sprayers may be attached to garden hoses and typically include nozzles that constrict the flow path of water in order to condition the flow for various applications, such as cleaning windows, washing a car, watering plants, etc. Flow rate and water pressure are limited by the water source supplying water to the garden hose sprayer, which may be insufficient for some applications.

Pressure washers typically include pumps to increase the pressure of water for heavy-duty cleaning and resurfacing applications. The water pressure is greatly increased relative to a typical garden hose sprayer, but the flow rate may be decreased and the intensity of the spray may be too great from some applications, such as cleaning windows and watering plants.

Garden hose booster systems increase water pressure relative to the household water supply, such as for cleaning and other general outdoor tasks. However, the water pressure increase by the garden hose booster is typically less than that of a pressure washer. A need exists for a water spraying device configured for a wide variety of outdoor cleaning applications. A need also exists to improve the "flushing" or "rinsing" capability of pressure washers, particularly electric pressure washers, (e.g., to wash away debris or rinse an object being cleaned).

SUMMARY

One embodiment of the invention relates to a pressure washer including a prime mover, a water pump coupled to the prime mover, the water pump including a pump inlet for receiving fluid from a fluid source and a pump outlet for supplying a pressurized primary fluid, a jet pump including a primary fluid inlet fluidly coupled to the pump outlet, a secondary fluid inlet configured to be coupled to the fluid source, and a fluid outlet, and a spray gun configured to be fluidly coupled to the fluid outlet of the jet pump, the spray gun including a spray gun outlet having a variable effective flow area. Wherein, in operation, a first effective flow area of the spray gun outlet creates a first back pressure at the jet pump, thereby implementing a high pressure operating mode in which the pressurized primary fluid flows through the jet pump and exits through the fluid outlet of the jet pump. Wherein, in operation, a second effective flow area of the spray gun outlet that is greater than the first effective flow area creates a second back pressure less than the first back pressure at the jet pump, thereby implementing a high flow operating mode in which the pressurized primary fluid flows through the jet pump and entrains a secondary fluid supplied through the secondary fluid inlet from the fluid source so that the secondary fluid also flows through the jet pump, resulting in a combined fluid flow of the primary fluid and the secondary fluid exiting through the fluid outlet of the jet pump.

Another embodiment of the invention relates to an electric pressure washer including an electric motor, a power cord for supplying electricity to the electric motor, a water pump coupled to the electric motor, the water pump including a pump inlet for receiving fluid from a fluid source and a pump outlet for supplying a pressurized primary fluid, a jet pump including a primary fluid inlet fluidly coupled to the pump outlet, a secondary fluid inlet configured to be coupled to the fluid source, and a fluid outlet, and a spray gun configured to be fluidly coupled to the fluid outlet of the jet pump, the spray gun including a spray gun outlet having a variable effective flow area. Wherein, in operation, a first effective flow area of the spray gun outlet creates a first back pressure at the jet pump, thereby implementing a high pressure operating mode in which the pressurized primary fluid flows through the jet pump and exits through the fluid outlet of the jet pump. Wherein, in operation, a second effective flow area of the spray gun outlet that is greater than the first effective flow area creates a second back pressure less than the first back pressure at the jet pump, thereby implementing a high flow operating mode in which the pressurized primary fluid flows through the jet pump and entrains a secondary fluid supplied through the secondary fluid inlet from the fluid source so that the secondary fluid also flows through the jet pump, resulting in a combined fluid flow of the primary fluid and the secondary fluid exiting through the fluid outlet of the jet pump.

Another embodiment of the invention relates to a pressure washer including a prime mover, a water pump coupled to the prime mover, the water pump including a pump inlet for receiving fluid from a fluid source and a pump outlet for supplying a pressurized primary fluid, a jet pump, and a spray gun configured to be fluidly coupled to the fluid outlet of the jet pump, the spray gun including a spray gun outlet having a variable effective flow area. The jet pump includes a primary fluid inlet fluidly coupled to the pump outlet, a secondary fluid inlet configured to be coupled to the fluid source, and a fluid outlet, a mixing chamber fluidly upstream of the fluid outlet and fluidly coupled to the secondary fluid inlet, a nozzle having a restriction, wherein the nozzle is fluidly coupled between the primary fluid inlet and the fluid outlet so that the pressurized primary fluid flows through the restriction prior to entering the mixing chamber, a bypass conduit fluidly coupled to the pump outlet and the mixing chamber to provide a bypass flow path that bypasses the nozzle, and a bypass valve disposed in the bypass conduit and configured to move between an open position and a closed position to selectively open and close the bypass conduit. Wherein, in operation, a first effective flow area of the spray gun outlet creates a first back pressure at the jet pump, thereby implementing a high pressure operating mode in which the pressurized primary fluid flows through the jet pump and exits through the fluid outlet of the jet pump. Wherein, in operation, a second effective flow area of the spray gun outlet that is greater than the first effective flow area creates a second back pressure less than the first back pressure at the jet pump, thereby implementing a high flow operating mode in which the pressurized primary fluid flows through the jet pump and entrains a secondary fluid supplied through the secondary fluid inlet from the fluid source so that the secondary fluid also flows through the jet pump, resulting in a combined fluid flow of the primary fluid and the secondary fluid exiting through the fluid outlet of the jet pump. Wherein, in the high pressure operating mode, the bypass valve is in the open position and the pressurized primary fluid flows through both the nozzle and the bypass flow path to the fluid outlet of the jet pump and wherein, in the high flow operating mode, the bypass valve is in the closed position.

Another embodiment of the invention relates to a water pump including a pumping mechanism for pressurizing a primary fluid flow, the pumping mechanism including a pump inlet for receiving fluid from a fluid source and a pump outlet for supplying a pressurized primary fluid and a jet pump including a primary fluid inlet fluidly coupled to the pump outlet, a secondary fluid inlet configured to be coupled to a fluid source, and a fluid outlet. Wherein, in operation, at a first back pressure at the jet pump, a high pressure operating mode is implemented in which the pressurized primary fluid flows through the jet pump and exits through the fluid outlet of the jet pump. Wherein, in operation, at a second back pressure that is less than the first back pressure at the jet pump, a high flow operating mode is implemented in which the pressurized primary fluid flows through the jet pump and entrains a secondary fluid supplied through the secondary fluid inlet from the fluid source so that the secondary fluid also flows through the jet pump, resulting in a combined fluid flow of the primary fluid and the secondary fluid exiting through the fluid outlet of the jet pump.

Another embodiment of the invention relates to a jet pump including a primary fluid inlet configured to be fluidly coupled to a source of a pressurized primary fluid, a secondary fluid inlet configured to be fluidly coupled to a source of a secondary fluid, a fluid outlet, a mixing chamber fluidly upstream of the fluid outlet and fluidly coupled to the secondary fluid inlet, a nozzle having a restriction, wherein the nozzle is fluidly coupled between the primary fluid inlet and the fluid outlet so that the pressurized primary fluid flows through the restriction prior to entering the mixing chamber, a bypass conduit fluidly coupled to the mixing chamber to provide a bypass flow path that bypasses the nozzle, and a bypass valve disposed in the bypass conduit and configured to move between an open position and a closed position to selectively open and close the bypass conduit. Wherein the bypass valve is configured to move between the open position and the closed position in response to a back pressure at the jet pump. Wherein, at a first back pressure at the jet pump, the bypass valve is in the open position and at a second back pressure at the jet pump that is less than the first back pressure, the bypass valve is in the closed position.

Another embodiment of the invention relates to a jet pump kit for use with a water pump including a jet pump including a primary fluid inlet configured to be fluidly coupled to a pump outlet of a water pump to receive a pressurized primary fluid, a secondary fluid inlet configured to be fluidly coupled to a secondary fluid supply to receive a secondary fluid, and a fluid outlet, and a spray gun including a spray gun outlet having a variable effective flow area.

Another embodiment of the invention relates to a jet pump kit for use with a water pump including a jet pump including a primary fluid inlet configured to be fluidly coupled to a pump outlet of a water pump to receive a pressurized primary fluid, a secondary fluid inlet configured to be fluidly coupled to a secondary fluid supply to receive a secondary fluid, and a fluid outlet, a first spray gun including a spray gun outlet having a first effective flow area, and a second spray gun including a spray gun outlet having a second effective flow area that is greater than the first effective flow area.

Another embodiment of the invention relates to a pressure washer including a prime mover, a water pump coupled to the prime mover, the water pump including a pump inlet for receiving fluid from a fluid source and a pump outlet for supplying a pressurized primary fluid, a jet pump including a primary fluid inlet fluidly coupled to the pump outlet, a secondary fluid inlet configured to be coupled to the fluid source, and a fluid outlet, a first spray gun configured to be fluidly coupled to the fluid outlet of the jet pump, the first spray gun having a first effective flow area, and a second spray gun configured to be fluidly coupled to the fluid outlet of the jet pump, the second spray gun having a second effective flow area that is greater than the first effective flow area. Wherein, in operation, with the first spray gun fluidly coupled to the fluid outlet, the first effective flow area creates a first back pressure at the jet pump, thereby implementing a high pressure operating mode in which the pressurized primary fluid flows through the jet pump and exits through the fluid outlet of the jet pump. Wherein, in operation, with the second spray gun fluidly coupled to the fluid outlet, the second effective flow area of the spray gun outlet greater creates a second back pressure that is less than the first back pressure at the jet pump, thereby implementing a high flow operating mode in which the pressurized primary fluid flows through the jet pump and entrains a secondary fluid supplied through the secondary fluid inlet from the fluid source so that the secondary fluid also flows through the jet pump, resulting in a combined fluid flow of the primary fluid and the secondary fluid exiting through the fluid outlet of the jet pump.

Another embodiment of the invention relates to a method of varying flow in response to back pressure including providing a pressurized fluid to a jet pump, creating a first back pressure at the jet pump, implementing a high pressure operating mode in response to the first back pressure in which the pressurized fluid flows through the jet pump, creating a second back pressure at the jet pump, wherein the second back pressure is less than first back pressure, and implementing a high flow operating mode in response to the second back pressure in which the pressurized fluid flows through the jet pump and entrains a secondary fluid to result in a combined fluid flow exiting the jet pump.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
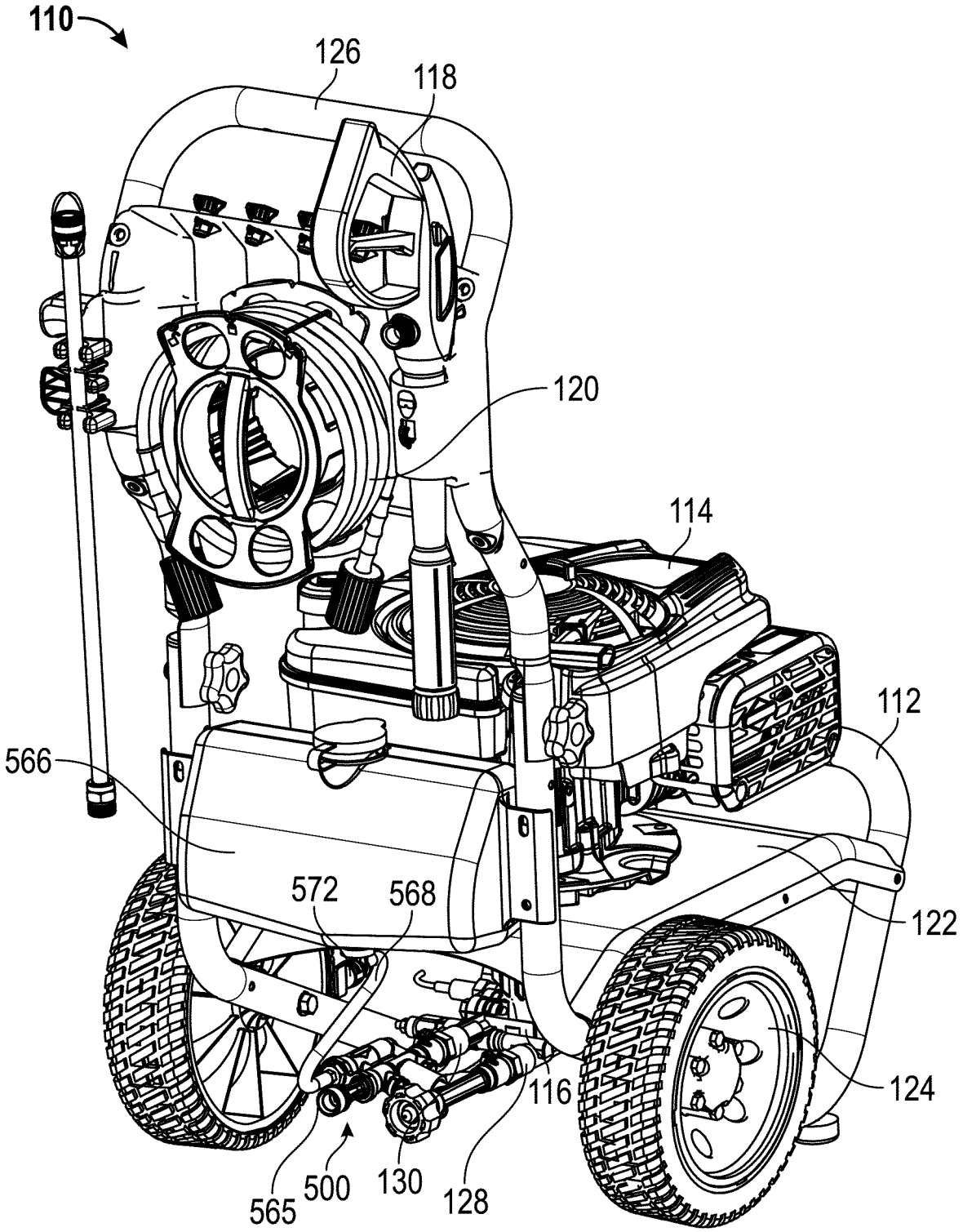
FIG. 1 is a perspective view of a pressure washer.

Referring to FIG. 1, a pressure washer 110 includes a frame 112 supporting a prime mover 114, such as an internal combustion engine, and a water pump 116 (e.g., positive displacement pump, piston water pump, axial cam pump) configured to be connected to a spray gun 118 with a delivery conduit 120 (e.g., a high-pressure hose). In other embodiments, an electric motor is used as the prime mover 114. In some embodiments, the prime mover 114 is fastened to the top of a base plate 122 of the frame 112 and the water pump 116 is mounted below the base plate 122 and connected to a power takeoff of the prime mover 114 via a hole through the base plate 122. In other embodiments, the water pump is directly coupled to and supported by the engine or prime mover. The water pump 116 is coupled (e.g., directly coupled, indirectly coupled by a transmission, belts, gears, or other drive system) to the prime mover 114 to be driven by the prime mover 114. In some embodiments, the pressure washer 110 is portable and includes wheels 124 and a handle 126. In other embodiments, the pressure washer 110 may be stationary. In other embodiments, the pressure washer 110 is mounted to a trailer or other vehicle. The water pump 116 includes a pump inlet 128 and a pump outlet 130. The pump inlet 128 is configured to be coupled to a supply conduit or hose, which is in turn connected to a fluid supply (e.g., a spigot connected to a municipal water supply or well). In some embodiments, the pump inlet 128 includes a low-pressure, garden-hose style fitting for coupling a garden hose to the pump inlet 128. The pump outlet 130 includes a high-pressure fitting (e.g., an M22 fitting) for coupling the pump outlet 130 to the delivery conduit 120 or other device including an appropriate high pressure fitting. As shown in FIG. 1, pressure washer 110 uses a vertical shaft engine. According to an alternative embodiment, the prime mover may be a horizontal shaft engine.

Figure 2:
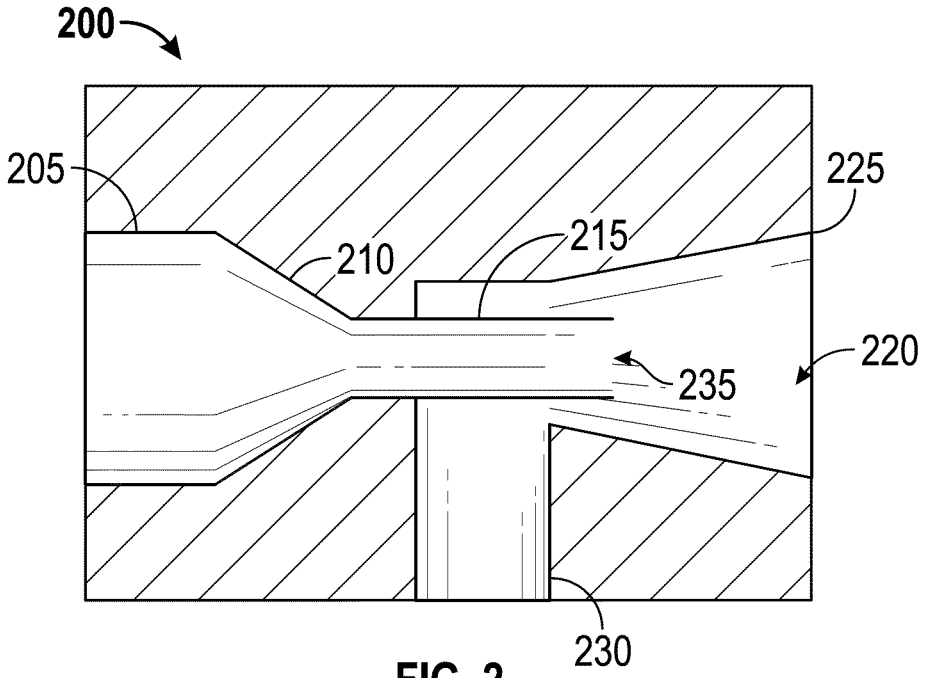
FIG. 2 is a schematic view of a flow multiplier.

Referring to FIG. 2, a flow multiplier, flow inducer, entrainment device, ejector, eductor, or jet pump 200 is illustrated. The flow multiplier 200 functions to provide the pressure washer 110 with at least two operating modes: a high-pressure mode and a high-flow mode. "Flow" means volumetric flow rate and is frequently measured in gallons per minute ("gpm"). The flow multiplier 200 includes a primary fluid inlet 205 fluidly coupled to the pump outlet 130, a restriction or narrowing section 210 downstream of the primary fluid inlet 205, a primary fluid nozzle 215 downstream of the narrowing section 210, a mixing chamber 220 having a fluid outlet 225, and a secondary fluid inlet 230 in fluid communication with the mixing chamber 220. The primary fluid inlet 205 may be directly coupled to the pump outlet 130 or remotely coupled to the pump outlet 130 (e.g., by a high pressure conduit or hose).

Figure 3A:
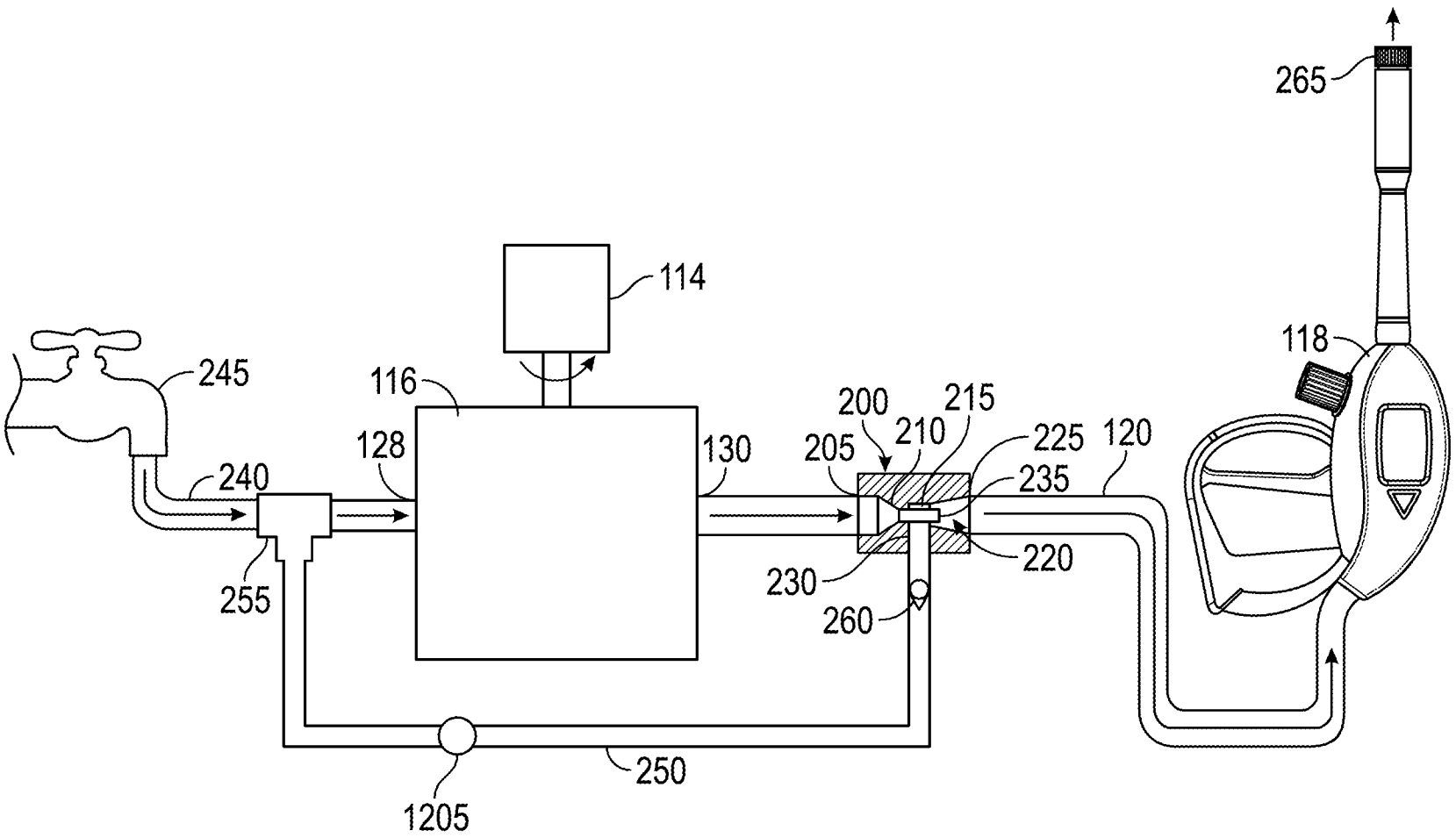
FIG. 3A is a schematic view of a portion of a pressure washer including the flow multiplier of FIG. 2, operating according to a first operating mode.
Figure 3B:
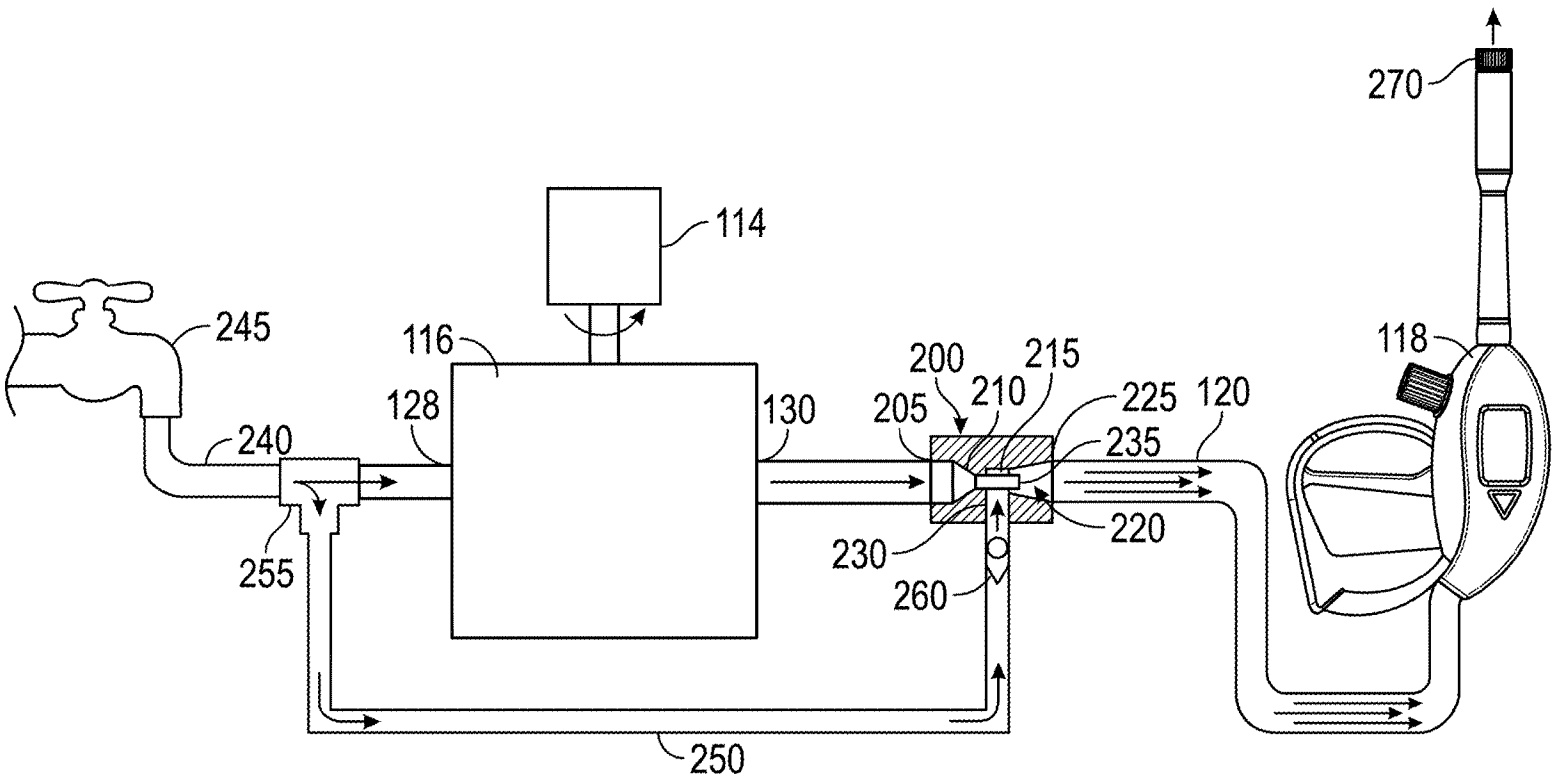
FIG. 3B is a schematic view of a portion of a pressure washer including the flow multiplier of FIG. 2, operating according to a second operating mode.

Referring to FIGS. 3A-3B, the primary fluid inlet 205 is configured to be coupled to the pump outlet 130 (e.g., by a high-pressure fitting) and allows primary fluid to enter the flow multiplier 200. Alternatively, the primary fluid inlet 205 may be coupled to a high pressure side of the water pump 116, but still within the casing of water pump 116. For example, fluid inlet 205 may be provided inline and downstream of the pumping mechanism (e.g., one or more pump pistons), the pump outlet 130, or the pump manifold to which fluid exits from the pumping mechanism. The flow multiplier 200 could be provided upstream or downstream of the unloader valve provided in the water pump 116. The unloader valve allows fluid to recirculate from the high pressure side to the low pressure side of the pump 116 when fluid flow from the pump outlet 130 is stopped (e.g., when flow from the spray gun 118 is stopped). The narrowing section 210 connects the primary fluid inlet 205 and the nozzle 215. The diameter of the narrowing section 210 decreases in the direction of fluid flow from the primary fluid inlet 205 to the nozzle 215. The nozzle 215 extends into the mixing chamber 220 and includes a nozzle outlet 235 located within the mixing chamber 220.

The secondary fluid inlet 230 allows secondary fluid to enter the mixing chamber 220. The secondary fluid inlet 230 is fluidly coupled to a fluid supply. In a preferred embodiment, the secondary fluid inlet 230 and the pump inlet 128 share a common fluid supply (e.g., a garden hose spigot or inlet hose). In some embodiments, the secondary fluid inlet 230 includes a low-pressure, garden-hose style fitting. In other embodiments, inlet 230 is fed from a tee fitting 255 provided upstream of the pump that diverts or branches flow from a water source (e.g., a spigot connected to a municipal water supply or well) into two streams. The first stream is provided to the pump inlet 128, the second stream is provided to the secondary fluid inlet 230. In some operating modes, secondary fluid flows through the secondary inlet 230 into the mixing chamber 220, where the secondary fluid is entrained with the primary fluid exiting the nozzle 215 at the outlet 235, resulting in a combined fluid flow that exits the flow multiplier 200 through the fluid outlet 225. In some embodiments, the fluid outlet 225 includes a high-pressure fitting.

Referring to FIGS. 3A and 3B, a portion of a pressure washer 110 including a flow multiplier 200 is illustrated. The primary fluid inlet 205 is fluidly coupled to the pump outlet 130. According to an exemplary embodiment, the pump outlet 130 provides water pressurized to 3000 pounds per square inch (20.68 MPa) ("psi") and at a flow rate of 2.5 gpm (9.5 l/min). A conventional high pressure water pump used on multi-purpose pressure washers may be utilized, such as an Annovi Reverberi RMW Series Pump. A supply conduit 240 (e.g., a low pressure hose) is fluidly coupled to the pump inlet 128 and a fluid supply 245. In some embodiments, the fluid supply 245 is a municipal water supply or well. A secondary fluid conduit 250 (e.g., a lower pressure hose) is fluidly coupled to the secondary fluid inlet 230. The secondary fluid conduit 250 is fluidly coupled to the supply conduit 240 by a tee fitting 255 so that the secondary fluid conduit 250 is fluidly connected to the fluid supply 245. In some embodiments, the tee fitting 255 is located at the pump inlet 128. In other embodiments, a tee fitting or a Y-fitting is provided at the fluid supply, with one outlet of the fitting fluidly coupled to the supply conduit 240 and the other outlet of the fitting fluidly coupled to the secondary fluid conduit 250. In some embodiments, the tee fitting 255 includes a check valve to prevent fluid flow towards the fluid source. A check valve 260 is positioned along the secondary fluid conduit 250 to prevent back flow, that is, fluid flow from the mixing chamber 220 towards the fluid supply 245. For a back pressure at the flow multiplier 200 above a threshold pressure, the check valve 260 is closed and a relatively high pressure, low flow fluid stream will be provided from the spray gun 118. For a back pressure at the flow multiplier 200 below the threshold pressure, the check valve 260 is open and a relatively low pressure, high flow fluid stream will be provided from the spray gun 118. The delivery conduit 120 (e.g., a high pressure hose) is fluidly coupled to the fluid outlet 225. The spray gun 118 is fluidly coupled to the opposite end of the delivery conduit 120.

Figure 5:
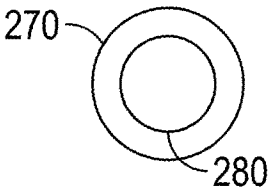
FIG. 5 is a front view of a second nozzle for use with the pressure washer of FIG. 3.
Figure 4:
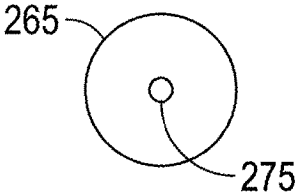
FIG. 4 is a front view of a nozzle for use with the pressure washer of FIG. 3.

Referring to FIGS. 3A-5, the spray gun 118 includes at least two alterable, changeable, or interchangeable nozzles 265 and 270. As shown in FIG. 4, the first nozzle 265 has a first effective flow area 275 (e.g., diameter or cross-sectional area) suitable for generating a relatively high-pressure, low-flow fluid stream (e.g., 3000 psi (20.68 MPa) at 2.5 gpm (9.5 l/min) for a gas pressure washer, 1700 psi (11.72 MPa) at 1.3 gpm (4.9 l/min) for an electric pressure washer). As shown in FIG. 5, the second nozzle 270 has a second effective flow area 280 (e.g., diameter or cross-sectional area) that is greater than the first flow area 275 and is suitable for generating a relatively low-pressure, high-flow fluid stream (e.g., 450 psi (3.103 MPa) at 5.0 gpm (18.9 l/min) for a gas pressure washer, 150 psi (1.034 MPa) at 4.5 gpm (17.0 l/min) for an electric pressure washer). The high-pressure, low-flow fluid stream generated by the first nozzle 265 may atomize immediately or soon after the fluid stream exits the first nozzle 265. The high-pressure, low-fluid stream is suitable for pressure washing applications like removing debris, dirt, grime, mold, etc. from a deck, patio, fence, or other surface or structure. The low-pressure, high-flow fluid stream generated by the second nozzle 270 substantially maintains its shape for a sizable distance from the second nozzle 270. The low-pressure, high-flow fluid stream is a coherent or concentrated stream that can be sent sizable distances from the spray gun 118. In some embodiments, the second nozzle 270 includes flow conditioning elements (e.g., multiple parallel flow conduits through which the fluid flows) to improve stream coherence. Such flow conditioning elements are described in U.S. application Ser. No. 12/429,028, filed on Apr. 23, 2009 and published as US 2010/0270402, which is incorporated herein by reference in its entirety. The low-pressure, high-flow fluid stream is suitable for flushing or low-pressure cleaning at a distance. For example, the low-pressure, high-flow fluid stream could be used to clean second floor windows, knock a bee's nest from a tree or an eave, or, with an appropriate gutter cleaning attachment, clean out gutters while the user remains standing on the ground. A trigger on the spray gun 118 is used to stop and start the flow of fluid through the spray gun 118.

In some embodiments, the at least two nozzles 265 and 270 are different settings of the spray gun 118 and can be selected by the user by twisting, clicking, or otherwise moving between positions (e.g., a turret nozzle). In other embodiments, an individual nozzle 265 or 270 is selected and attached to the spray gun by a fitting (e.g., a quick-connect fitting). In other embodiments, each nozzle is a component of a distinct spray gun, so that a first spray gun includes nozzle 265 and a second spray gun includes nozzle 270. In other embodiments, a single nozzle (e.g., a variable nozzle) can be adjusted (e.g., by twisting, clicking, or otherwise moving) to resize the effective flow area of the single nozzle, thereby providing multiple settings equivalent to the at least two nozzles 265 and 270 described above.

In use, the water pump 116 pumps primary fluid received through the pump inlet 128 and outputs the primary fluid at an increased pressure through the pump outlet 130, thereby developing pressurized primary fluid due to the restrictions present downstream of the pump outlet 130 (e.g., the restriction created by the nozzle and/or other downstream components currently in use). In some embodiments, the water pump 116 is capable of developing pressures of up to 500 pounds per square inch (3.447 MPa) ("psi"), or in other embodiments, 5000 psi (34.47 MPa) and above. In some embodiments, the water pump 116 is capable of developing pressures in a range of 1000-5000 psi (6.895-34.47 MPa), preferably 1500-4000 psi (10.34-27.58 MPa). In some embodiments, the water pump 116 is capable of developing pressures of 100 psi (689.5 kPa) or more.

As shown in FIG. 3B, for a high-flow operating mode, the high-flow or second nozzle 270 is selected at the spray gun 118. The water pump 116 provides pressurized primary fluid to the flow multiplier 200. The primary fluid enters the flow multiplier at the inlet 205 and is restricted by the narrowing section 210 and the nozzle 215. The primary fluid continues through the nozzle 215 and exits at the outlet 235 into the mixing chamber 220. The flow of primary fluid through the mixing chamber 220 creates a vacuum or low pressure zone in the mixing chamber (e.g., through a Bernoulli or Venturi effect or a combination of the two). The pressure differential between the low pressure zone and the secondary fluid in the secondary fluid conduit 250 and/or the vacuum or low pressure zone is sufficient to open the check valve 260 and pull secondary fluid into the mixing chamber 220 through the secondary fluid inlet 230. Once in the mixing chamber 220, the secondary fluid is entrained with the primary fluid, greatly increasing the volume of flow as compared to the primary fluid on its own. This combined fluid flow exits the mixing chamber 220 through the fluid outlet 225 and travels through the delivery conduit 120 to the spray gun 118. The combined fluid flow exits the spray gun 118 through the second nozzle 270 as a lower-pressure, higher-flow fluid stream (as compared to the high-pressure operation described below). In some embodiments, the effective flow area of the primary fluid nozzle 215 is less than the effective flow area 280 of the high-flow nozzle 270.

As shown in FIG. 3A, for a high-pressure operating mode, the high-pressure or first nozzle 265 is selected at the spray gun 118. The relatively small first flow area 275 restricts the flow of fluid through the first nozzle 265 and causes a back pressure at the jet pump 200 (e.g., in the mixing chamber 220). This back pressure dominates or overcomes the low pressure zone that would otherwise be created by the high pressure primary fluid flow exiting the nozzle 215 and so that secondary fluid does not enter the mixing chamber 220. The check valve 260 also is closed in the high-pressure operating mode. The primary fluid exits the mixing chamber 220 through the fluid outlet 225 and travels through the delivery conduit 120 to the spray gun. The primary fluid exits the spray gun 118 through the first nozzle 265 as a higher-pressure, lower-flow fluid stream (as compared to the high-flow operation described above). In some embodiments, the effective flow area (e.g., the diameter or cross-sectional area) of the primary fluid nozzle 215 is greater than the effective flow area 275 of the high-pressure nozzle 265.

The operating mode is selected by changing the nozzle of the spray gun 118 and thereby changing the back pressure at the flow multiplier 200 (e.g., in the mixing chamber 220). The user is able to quickly and easily change between the high flow and high pressure operating modes by simply switching between the appropriate nozzles. There is no need to adjust a switch, dial, or other interface at the body of the pressure washer. Multiple high pressure operating modes and multiple high flow operating modes are possible, with each operating mode associated with a different nozzle having a different effective flow area.

Figure 6:
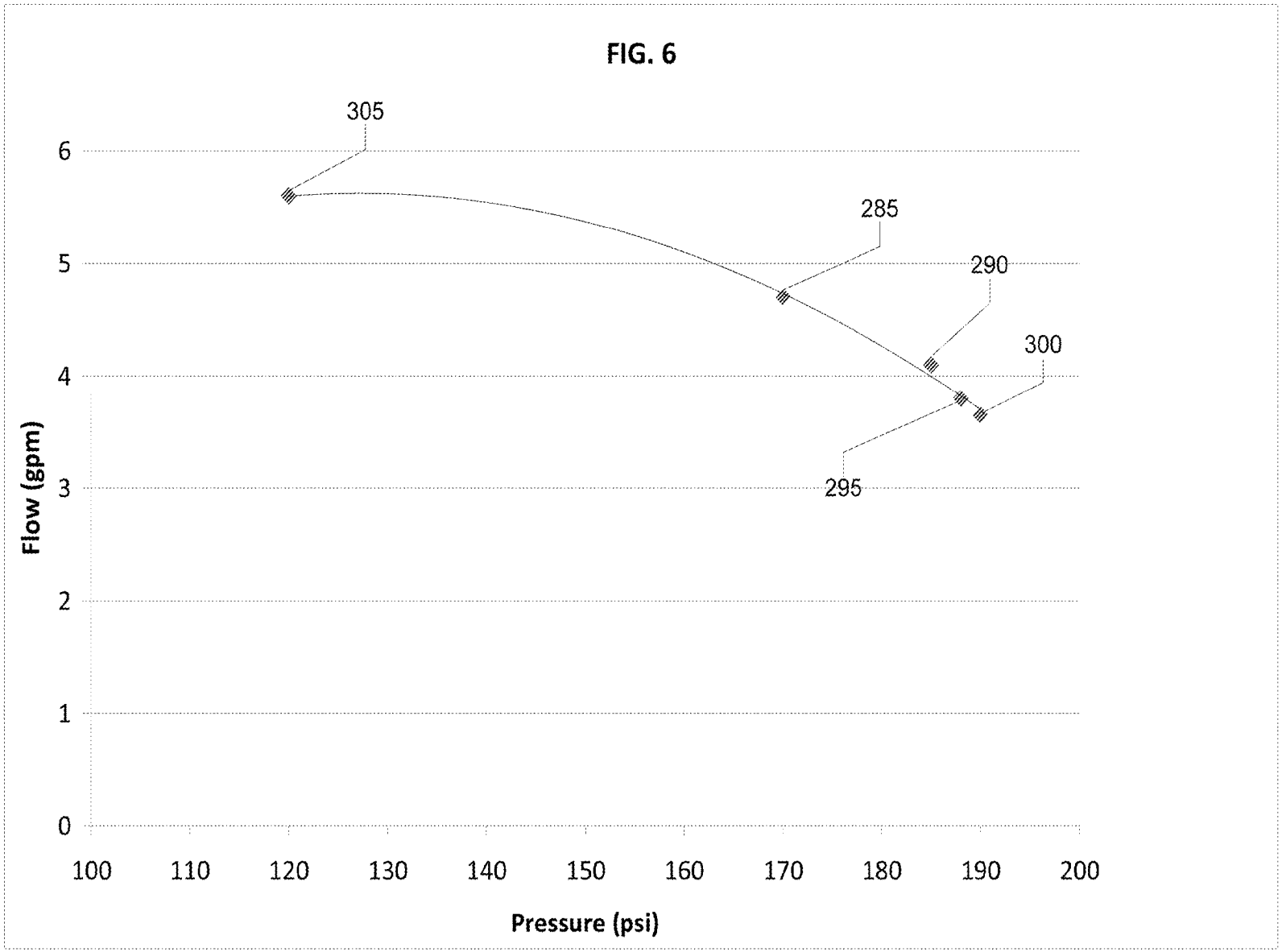
FIG. 6 is a plot comparing the flow and pressure resulting from various nozzles used with a pressure washer including a flow multiplier.

With reference to FIG. 6, Applicant performed a test to compare the fluid pressure and flow output from the spray gun of a pressure washer including a flow multiplier for four different low pressure, high flow nozzles (285, 290, 295, 300), a high pressure, low flow nozzle, and with no nozzle. To test the impact of the flow multiplier, a test system was developed that allowed the fluid exiting the water pump to either flow through the flow multiplier or bypass the flow multiplier. Measurements of flow rate and water pressure were taken downstream of the flow multiplier. With no nozzle, the water pump not running, and bypassing the flow multiplier (so that no fluid flows through flow multiplier), the fluid output was 0.57 gpm (2.2 l/min). With no nozzle, the water pump not running, and using the flow multiplier, the fluid output was 2.45 gpm (9.3 l/min). With no nozzle, the water pump running, and bypassing the flow multiplier, the fluid output was 2.8 gpm (10.6 l/min). With no nozzle (data point 305), the water pump running, and using the flow multiplier, the fluid output was 5.6 gpm (21.2 l/min) at 120 psi (827.4 kPa). With no nozzle and the water pump running, the addition of the flow multiplier doubled the flow rate from 2.8 gpm (10.6 l/min) to 5.6 gpm (21.2 l/min). With nozzle 285, the water pump running, and using the flow multiplier, the fluid output was 4.7 gpm (17.8 l/min) at 170 psi (1.172 MPa). With nozzle 290, the water pump running, and using the flow multiplier, the fluid output was 4.1 gpm (15.5 l/min) at 185 psi (1.276 MPa). With nozzle 295, the water pump running, and using the flow multiplier, the fluid output was 3.8 gpm (14.4 l/min) at 188 psi (1.296 MPa). With nozzle 300, the water pump running, and using the flow multiplier, the fluid output was 3.35 gpm (12.7 l/min) at 190 psi (1.31 MPa). With a conventional, high-pressure nozzle, the water pump running, and bypassing the flow multiplier (e.g., the test system operating as a conventional pressure washer), the fluid output was 2.5 gpm (9.5 l/min) at 2500 psi (17.24 MPa). FIG. 6 illustrates a plot of flow (in gpm) versus pressure (in psi) for the four different low pressure, high flow nozzles (285, 290, 295, 300) and no nozzle (305) tested by the applicant on a pressure washer 110 including a flow multiplier 200. In theory, the flow multiplier 200 provides fluid outputs that are infinitely variable between a maximum pressure, minimum flow mode and a minimum pressure, maximum flow mode as controlled by varying the flow area of the spray gun nozzle with the maximum pressure and flow determined by the prime mover 114 and pump 116 selected for use in the pressure washer 110.

The flow multiplier 200 can be included as a component of a pressure washer 110, included as a component of a water pump 116, included as a component of a flow multiplier kit that allows a user to retrofit a pressure washer, incorporated into a spray gun 118, or commercialized in other appropriate forms. In some embodiments, the flow multiplier kit includes the flow multiplier 200 and a spray gun 118. The spray gun outlet has a variable effective flow area (e.g., multiple nozzles able to be inserted into the spray gun 118, a turret including multiple nozzles, a single nozzle with a variable effective flow area) or the kit includes multiple spray guns where each spray gun has a different effective flow area to allow the user to select among high-pressure operating modes and high-flow operating modes. The kit can also include a high flow hose or conduit 120. The delivery conduit 120 included in many conventional pressure washers is a one quarter inch high pressure hose. To properly accommodate the increased flow provided by the flow multiplier, a high flow pressure hose or delivery conduit 120 (e.g., three eighths of an inch high pressure hose) is preferred. In some embodiments, a one quarter inch high pressure hose is used as the delivery conduit 120. In some embodiments, the kit can include two hoses or conduits (i.e., a high flow conduit and a high pressure conduit).

Figure 7:
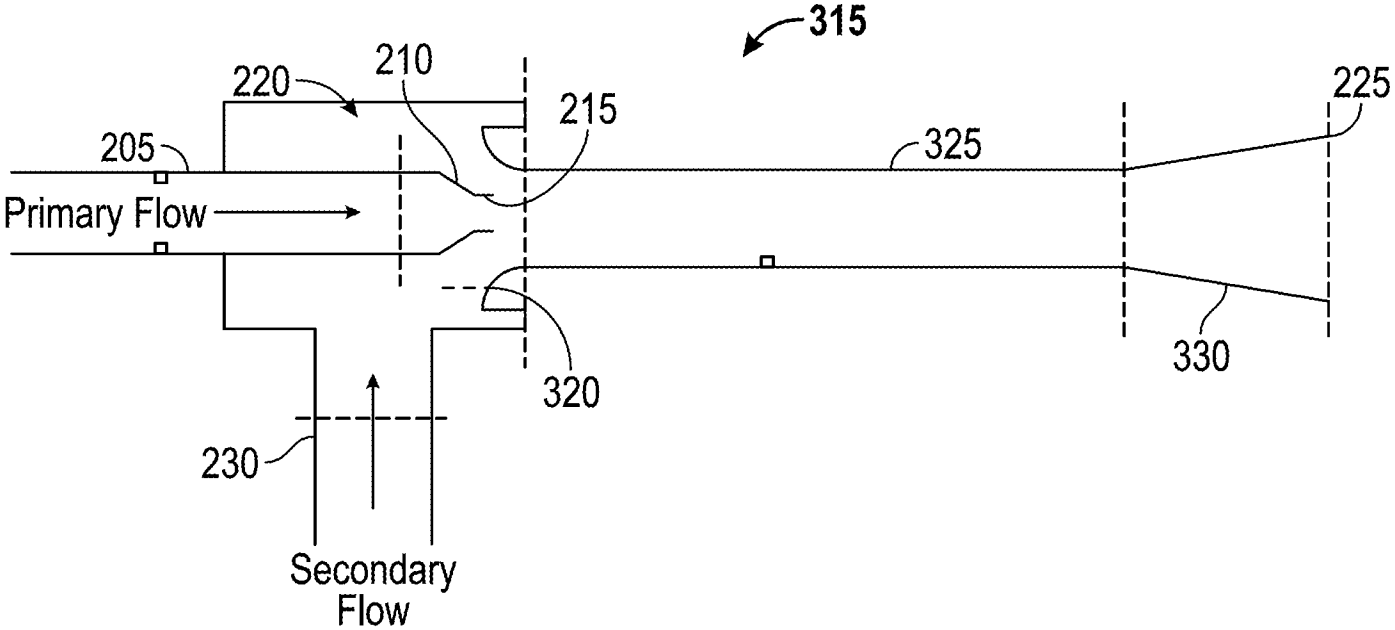
FIG. 7 is a schematic view of an alternative flow multiplier.

In some embodiments, a jet pump is used as the flow multiplier. One type of jet pump is illustrated in FIG. 2. Another type of jet pump 315 is illustrated in FIG. 7. The components of the jet pump 315 similar to those described above and illustrated in FIG. 2 are identified with the same reference numerals. The jet pump 315 also includes a converging cone 320 downstream of the secondary fluid inlet 230. The converging cone 320 defines an entrainment region. The mixing chamber 220 includes a constant diameter mixing region 325 and a diverging cone 330 through which fluid flows before reaching the fluid outlet 225.

It is believed that a jet pump functions best as a flow multiplier. However, it is possible that a venturi may be used as a flow multiplier. An advantage of the jet pump is that it includes fewer moving parts, and in some embodiments, no moving parts, than commercially available variable flow rate fluid pumps (e.g., mechanical fluid pumps providing variable displacement or other ways of varying fluid flow rate). Another advantage of the jet pump is that it uses a relatively small volume of primary fluid to entrain a relatively large volume of secondary fluid, resulting in a relatively large volume of combined fluid primarily consisting of the secondary fluid. A venturi uses a relatively large volume of primary fluid to entrain a relatively small volume of secondary fluid, resulting in a relatively large volume of combined fluid primarily consisting of the primary fluid. For example, the venturi in a carburetor uses a relatively large volume of air to entrain a relatively small volume of fuel to create an air-fuel mixture that is primarily air. In some embodiments, a blade driven pump (e.g., a turbo-charger) is used as the flow multiplier. A blade or impeller is positioned in the pressurized fluid flow and used to drive a pump to supply a secondary fluid. The turbo-charger can be selectively activated by a user input (e.g., a switch) or in response to a pressure differential somewhere in the pressure washer system (e.g., in response to the pressure change resulting from changing the effective flow area of the spray gun nozzle); otherwise, the turbo-charger can simply freewheel and provide no additional flow. Alternatively, the turbo-charger is positioned in a bypass flow path through which the pressurized fluid flow does not flow when no additional flow is needed. When the turbo-charger is activated (e.g., as described above), a valve directs at least a portion of the pressurized fluid flow through the bypass flow path and to the turbo-charger to provide additional flow. In some embodiments, when the turbo-charger is activated, the entire flow of pressurized fluid is directed through the bypass flow path. In other embodiments, when the turbo-charger is activated, a portion of the pressurized fluid flow is directed through the bypass flow path. In other embodiments, the flow multiplier is a structure that uses the kinetic energy of a first fluid stream to entrain or pump a second fluid stream.

The flow multiplier 200 allows a pressure washer 110 to provide a high volume or "boosted" flow without having to make mechanical changes to the water pump 116. Typically, to increase flow from a water pump 116, the pump would need to be changed mechanically, for example, by increasing piston stroke, changing the displacement of the pump, or operating the pump at higher speeds. To then operate a water pump 116 at different flows requires the ability to vary the mechanical changes to the water pump 116, for example, mechanically varying the piston stroke, mechanically varying the displacement, or operating the pump at varying speeds. The flow multiplier 200 eliminates the mechanical complexity that would otherwise be needed to operate the water pump 116 of a pressure washer 110 at different flow outputs by using the pressurized fluid output from the water pump 116 to create varying fluid flow outputs from the flow multiplier 200 in response to the back pressure from the spray gun 118. A single flow rate water pump (e.g., the water pump 116) and a flow multiplier 200 can provide cost savings when compared to other variable flow rate pumps (e.g., variable displacement, variable stroke, variable speed, etc.). Back pressure from the spray gun 118 can easily be changed by varying the effective flow area of the spray gun outlet. This allows a user to easily change between high flow and high pressure operating modes by simply changing the effective flow area of the spray gun outlet (e.g., by changing nozzles, adjusting an adjustable nozzle, or changing spray guns). Alternatively, a user adjustable restrictor (e.g., a valve, a dial, etc.) could be provided downstream of the flow multiplier 200 to vary the back pressure at the flow multiplier 200 and thereby change between high flow operating modes and high pressure operating modes.

Figure 8:
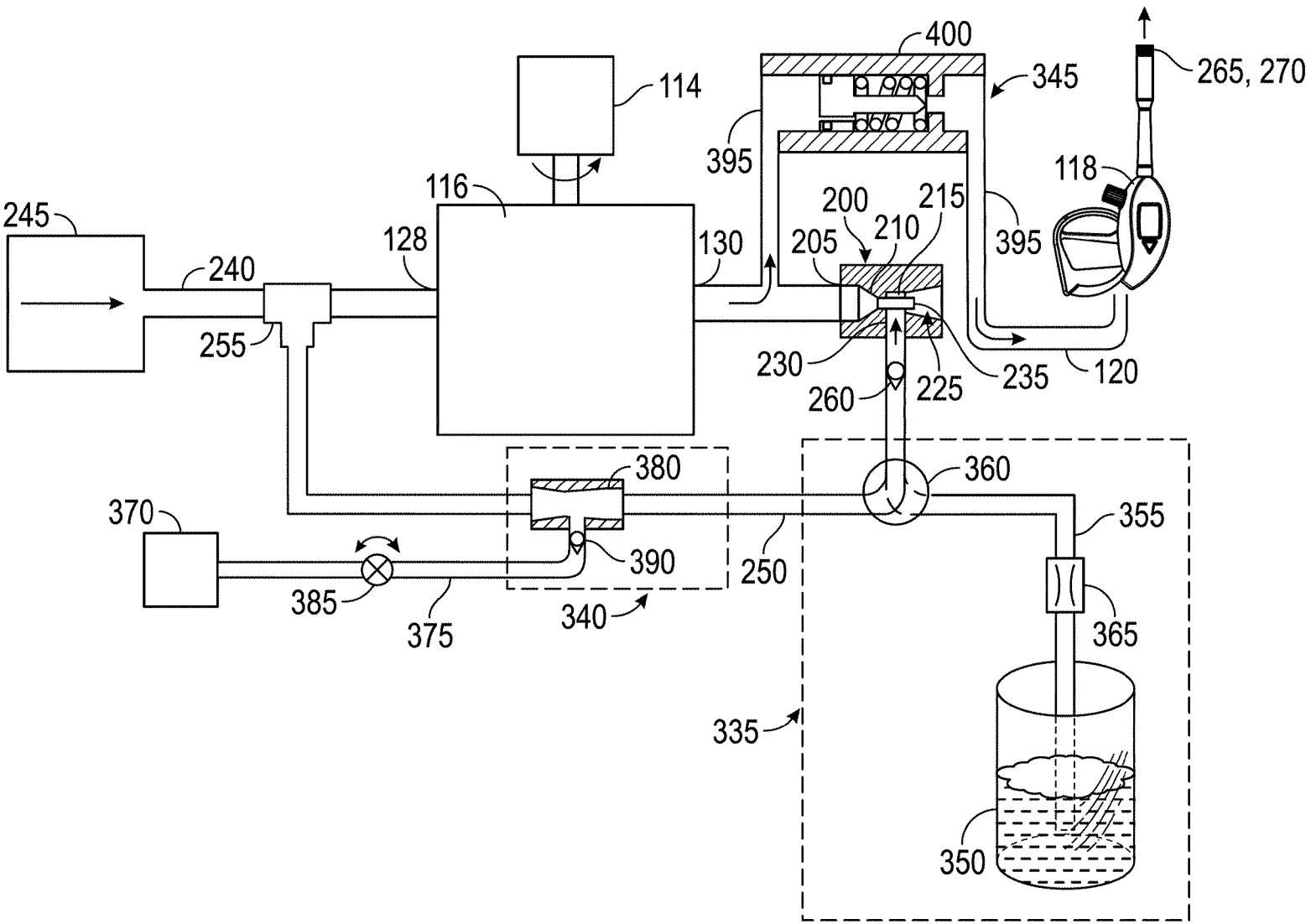
FIG. 8 is a schematic view of a portion of a pressure washer including a flow multiplier and optional chemical injection systems.

Referring to FIG. 8, a portion of a pressure washer 110 including a flow multiplier 200 is illustrated. FIG. 8 illustrates two optional chemical injection systems 335 and 340 and an optional differential pressure-activated bypass 345 around the flow multiplier 200.

Optional chemical system 335 includes a reservoir 350 fluidly coupled to the secondary fluid conduit 250 by a conduit 355 and a valve 360. The reservoir 350 contains a chemical, such as soap, detergent, spot-free rinse, a herbicide, polish, etc. The valve 360 is a two-position diverting valve that allows the user to select a "chemical" mode in which the chemical is allowed to flow through the valve 360 to the secondary fluid inlet 230 and the flow of secondary fluid through the valve 360 is stopped and an "off" mode in which secondary fluid is allowed to flow through the valve 360 and the flow of chemical through the valve 360 is stopped. Alternatively, the secondary fluid is allowed to mix with the chemical flow in the chemical mode or in a "mixed mode" in embodiments including a three-position valve. A restrictor 365 (e.g., a metering orifice) is positioned along the conduit 355 between the reservoir 350 and the valve 360. The restrictor 365 limits the amount of flow of chemical from the reservoir 350. In use, in the high-flow operating mode using nozzle 270 and with the valve 360 in the chemical mode, the pressure difference between the low pressure zone in the mixing chamber 220 and the reservoir 350 causes a flow of chemical from the reservoir 350 to the secondary fluid conduit 250. The chemical flow is entrained with the primary fluid in the mixing chamber 220, thereby providing a combined fluid flow including the primary fluid and the chemical to the spray gun 118. In some embodiments, a check valve is positioned in conduit 355 to prevent secondary fluid from flowing to the reservoir 350.

Optional chemical system 340 includes a reservoir 370 fluidly coupled to the secondary fluid conduit 250 by a conduit 375 and a venturi 380. The reservoir 370 contains the chemical to be added to the secondary fluid. An on/off valve 385 is positioned along the conduit 375 between the reservoir 370 and the venturi 380 and is movable between an "on" position in which the conduit 375 is open and an "off" position in which the conduit 375 is closed. Alternatively, valve 385 is variable to allow the user to meter the flow of chemicals from the reservoir 370. A check valve 390 is positioned along the conduit 375 between the on/off valve 385 and the venturi 380 to prevent back flow from the venturi 380 towards the reservoir 370. In use, in the high-flow operating mode with the on/off valve 385 in the on position, the flow of secondary fluid through the venturi 380 creates a Venturi effect that draws the chemical through the conduit 375 so that the chemical mixes with the secondary fluid flow. This mixed flow of secondary fluid and chemical is then entrained with the primary fluid flow in the mixing chamber 220, thereby providing a combined fluid flow including the primary fluid, the secondary fluid, and the chemical to the spray gun 118. In some embodiments, the chemical systems 335 and 340 include one or more additional reservoirs containing different chemicals than the first reservoir. The user may select among the reservoirs by actuating a selector valve that fluidly couples one of the reservoirs to the appropriate supply conduit.

The optional differential pressure-activated bypass 345 may be necessary if in the high-pressure operating mode, the flow multiplier 200 causes an unacceptable energy loss to the pressurized primary fluid flow and the output pressure from the spray gun 118 suffers unacceptable losses. If this is true, the differential pressure-activated bypass 345 allows a portion of the pressurized primary fluid flow to bypass the flow multiplier 200 in the high-pressure operating mode. The differential pressure-activated bypass 345 includes a conduit 395 in fluid communication with the water pump 116 and the delivery conduit 120 to partially bypass the flow multiplier 200 and a differential pressure-activated valve 400 (e.g., a needle and seat valve). The piston in the valve 400 is normally in the open position. In use, in the high-flow operating mode, a relatively large pressure differential occurs across the valve 400 (i.e., a relatively low pressure combined fluid flow at the outlet of the bypass conduit 395 and a relatively high pressure primary fluid low at the inlet of the bypass conduit 395, which closes the valve 400. In use, in the high-pressure operating mode, the differential pressure across the valve 400 is relatively low (i.e., relatively high pressure primary fluid flow at both the inlet and outlet of the bypass conduit 395) and the spring dominates, causing the valve 400 to open, thereby allowing the pressurized primary fluid flow to bypass the flow multiplier 200 through the conduit 395. In use, in the high-flow operating mode, the valve 400 is closed.

Referring to FIGS. 9-13, a flow multiplier or jet pump 500 is illustrated. Many features and uses of the jet pump 500 are similar to those described above for flow multiplier 200. The jet pump 500 includes a body 502, a primary fluid inlet 505, a primary fluid nozzle 510 including a primary fluid restriction 515 downstream of primary fluid inlet 505, a mixing chamber 520, a fluid outlet 525 downstream of the mixing chamber, and a secondary fluid inlet 530 fluidly coupled to the mixing chamber 520. The primary fluid inlet 505 opens into a primary fluid chamber 535 upstream of the primary fluid nozzle 510. An outlet conduit 540 is located between the mixing chamber 520 and the fluid outlet 525. The outlet conduit 540 defines an outlet passage 542 that includes a step 545 at which the diameter of the outlet passage 542 increases. An annular chamber 550 is formed between the exterior surface of the outlet conduit 540 and a portion of the body 502. A bypass conduit 555 fluidly couples the primary fluid inlet 505 to a location downstream of the primary fluid nozzle 510. As illustrated, the bypass conduit 555 fluidly couples the primary fluid chamber 535 to the annular chamber 550. A bypass valve 560 is disposed in the bypass conduit 555 to selectively open and close the bypass conduit 555. A chemical inlet 565 is located downstream of the mixing chamber 520.

The jet pump 500 is configured to operate in one of two different modes, a high pressure mode and a high flow mode, in response to the back pressure at the jet pump 500 (e.g., the back pressure at the fluid outlet 525, the mixing chamber 520, the primary fluid nozzle 510). When the back pressure is above a threshold pressure or pressure range, the high pressure mode is implemented. When the back pressure is below the threshold pressure or pressure range, the high flow mode is implemented. The back pressure at the jet pump 500 is established by the restrictions on flow downstream of the jet pump 500. For example, as will be discussed in more detail below, the back pressure at the jet pump 500 can be controlled by varying the effective flow area of a spray gun of a pressure washer. A spray gun including a nozzle with a relatively small effective flow area will create a relatively high back pressure at the jet pump 500, thereby implementing the high pressure operating mode, and a spray gun including a nozzle with a relatively large effective flow area will create a relatively low back pressure at the jet pump 500, thereby implementing the high flow operating mode.

The primary fluid inlet 505 is configured to be coupled to a source of pressurized primary fluid (e.g., the pump outlet 130). In some embodiments, the primary fluid inlet 505 is configured to be directly coupled to the pump outlet 130. In other embodiments, the primary fluid inlet 505 and/or the jet pump 500 are integrally formed with the water pump 116 (e.g., as a single unitary component). In other embodiments, the primary fluid inlet 505 is configured to be indirectly coupled to the pump outlet 130 (e.g., by a high pressure hose or conduit). The secondary fluid inlet 530 is configured to be fluidly coupled to a source of fluid (e.g., a municipal water supply or well). In some embodiments, the secondary fluid inlet 530 is configured to be fluidly coupled to the source of fluid by a low-pressure hose or conduit (e.g., a garden hose connected to a spigot). In a preferred embodiment, the primary fluid and the secondary fluid are drawn from the same source. For example, the pump inlet 128 of the pressure washer 110 and the secondary fluid inlet 530 of the jet pump 500 are connected to the same spigot (e.g., by a garden hose and a tee fitting 815). The secondary fluid inlet 530 makes secondary fluid available to the mixing chamber 520.

Figure 9:
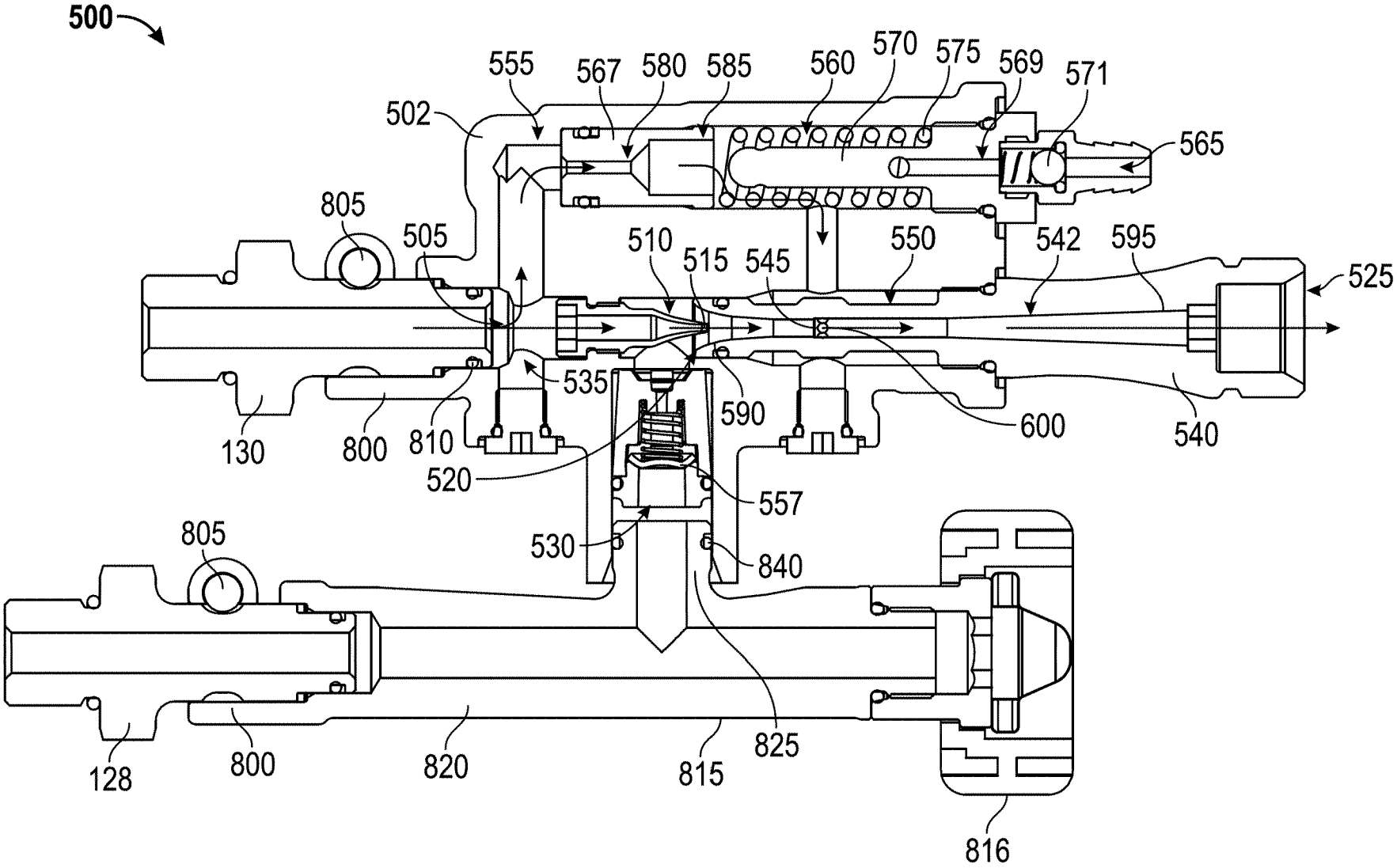
FIG. 9 is a sectional view of a flow multiplier along line 9-9 of FIG. 19, according to an exemplary embodiment, in a high pressure operating mode.

As shown in FIG. 9, in the high pressure operating mode, pressurized primary fluid enters the jet pump 500 via the primary fluid inlet 505. A first stream or flow of the pressurized primary fluid (shown by arrows in FIG. 9) flows through the primary fluid chamber 535 and through the primary fluid nozzle 510. A second stream or flow of the pressurized primary fluid (shown by arrows in FIG. 9) flows through the primary fluid chamber 535, through the bypass conduit 555 to a location downstream of the primary fluid nozzle 510 (e.g., openings 600) where it rejoins the first stream of the pressurized primary fluid to form a recombined high-pressure fluid stream or flow of the pressurized primary fluid (shown by arrows in FIG. 9) that exits the jet pump 500 through the fluid outlet 525. As illustrated, the first stream of the pressurized primary fluid exits the primary fluid nozzle 510 to the mixing chamber 520, and flows from the mixing chamber 520 through the outlet passage 542, where it rejoins the second stream of the pressurized primary fluid as the recombined high-pressure fluid stream of pressurized primary fluid. The second stream of the pressurized primary fluid flows through the bypass conduit 555 to the annular chamber 550 and then through one or more passages or openings 600 fluidly coupling the annular chamber 550 to the outlet passage 542, where it is rejoined with the first stream of the pressurized primary fluid as the recombined stream of pressurized primary fluid.

In the high pressure operating mode, the back pressure at the jet pump 500 (e.g., in the mixing chamber 520) caused by components downstream of the jet pump 500 (e.g., a spray gun, spray gun nozzle, etc.) dominates or overcomes the low pressure zone in the mixing chamber 520 that would otherwise be created by the high pressure primary fluid flow exiting the nozzle 510, thereby preventing secondary fluid from entering the mixing chamber 520. In the high pressure operating mode, a check valve 557 at or upstream of the secondary fluid inlet 530 is closed. In some embodiments, in the high pressure operating mode, a de minimis amount of secondary fluid may enter the mixing chamber 520.

Figure 10:
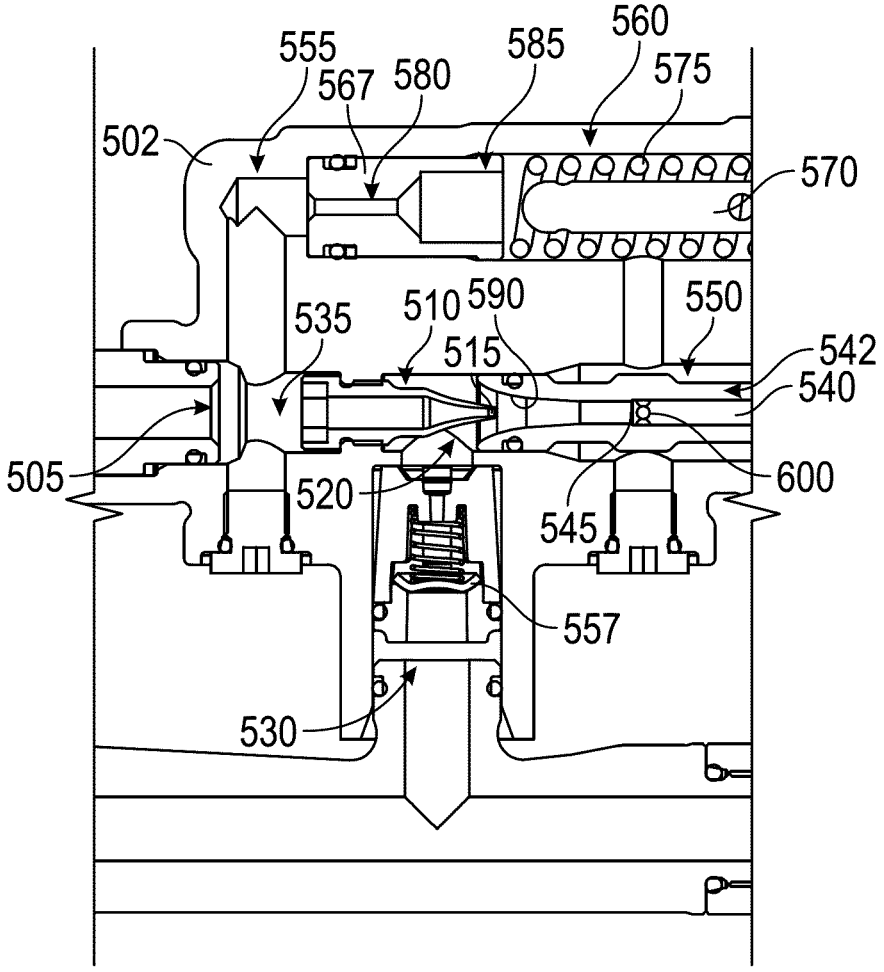
FIG. 10 is detail view of a portion of the flow multiplier of FIG. 9.
Figure 12:
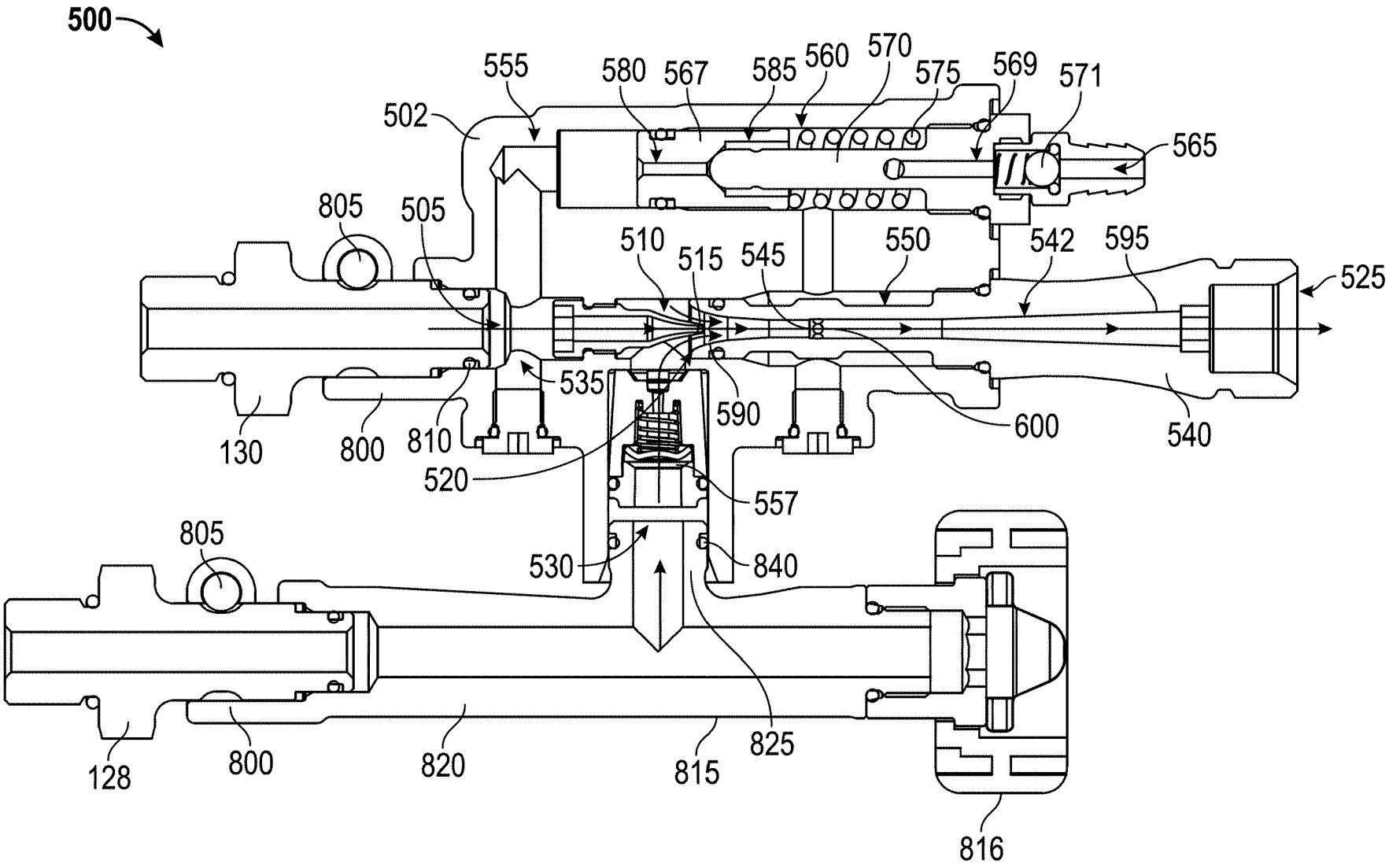
FIG. 12 is a sectional view of the flow multiplier of FIG. 9, in a high flow operating mode.
Figure 13:
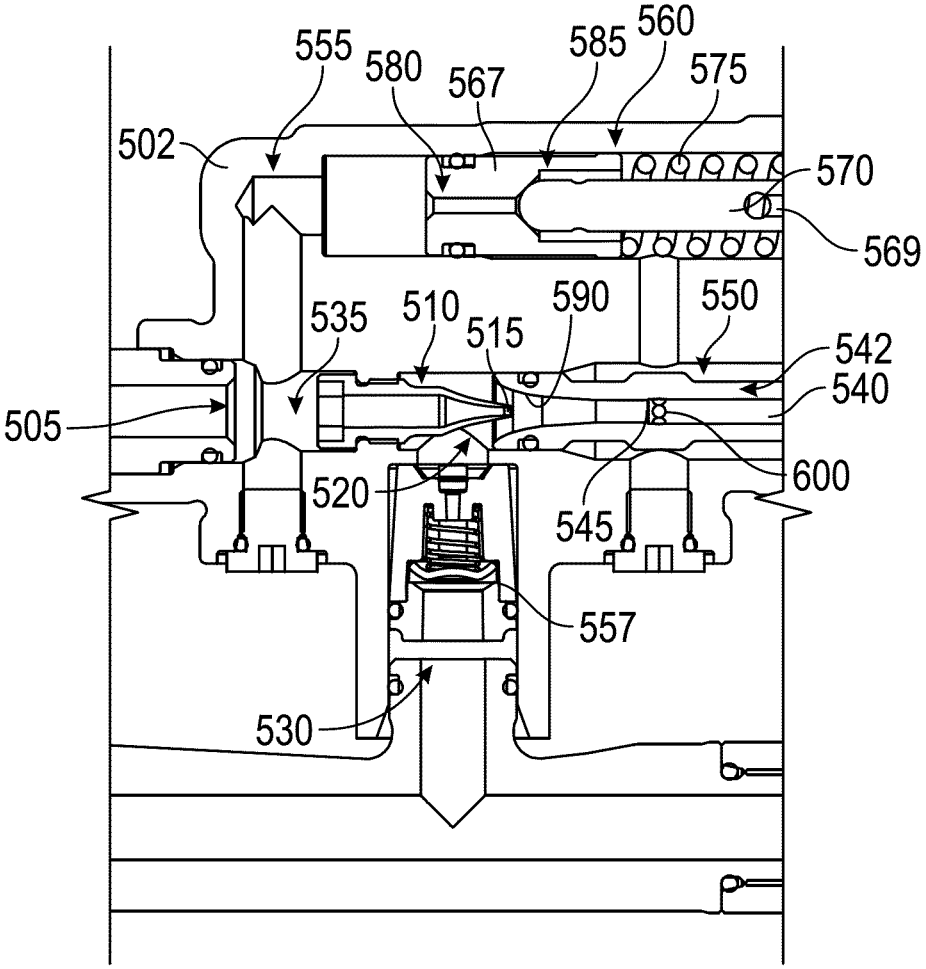
FIG. 13 is a detail view of a portion of the flow multiplier of FIG. 12.

The bypass conduit 555 ensures that the jet pump 500 provides an acceptable flow of pressurized fluid in the high pressure operating mode. Without the bypass conduit 555, all of the pressurized primary fluid would flow through the restriction 515, which, in some embodiments, could cause an unacceptable drop in the flow of pressurized fluid delivered from the jet pump 500. The bypass valve 560 moves between an open position (FIGS. 9 and 10) and a closed position (FIGS. 12 and 13) to selectively open and close the bypass conduit 555 in response to the fluid force exerted by the pressurized primary fluid on the face of a piston 567, the pressure difference across the bypass valve 560, and/or a biasing force (e.g., from a spring 575). As shown in FIGS. 9 and 10, in the high pressure operating mode, the pressure difference across the bypass valve 560 and/or the force applied by the spring 575 causes the valve to move to the open position, thereby allowing pressurized primary fluid to flow through the bypass conduit 555. As shown in FIGS. 12 and 13, in the high flow operating mode, the fluid force exerted by the pressurized primary fluid on the face of the piston 567 and/or the pressure difference across the bypass valve 560 causes the valve to move to the closed position, thereby preventing pressurized primary fluid from flowing through the bypass conduit 555. In the high pressure operating mode, the pressure difference across the bypass valve 560 is below a threshold pressure difference (e.g., the pressure difference is relatively small between the pressurized primary fluid flow at the primary fluid chamber 535 and the pressurized primary fluid flow at the outlet passage 542) and in the high flow operating mode, the pressure difference across the bypass valve 560 is above the threshold pressure difference (e.g., the pressure difference is relatively high between the pressurized primary fluid flow at the primary fluid chamber 535 and the combined fluid flow at the outlet passage 542).

The bypass valve 560 includes a movable piston 567, a seat or pintle 570, and a spring or biasing member 575. The piston 567 includes an opening 580 on the upstream side of piston 567 and a chamber 585 on the downstream side of the piston 567. In some embodiments, the opening 580 has a smaller diameter than the chamber 585. The chamber 585 is sized and shaped to receive the seat 570 so that with the piston 567 in the closed position, the seat 570 contacts or engages the surface or surfaces defining the chamber 585 to prevent fluid from flowing through the piston 567, thereby closing the bypass valve 560. In the open position, the piston 567 is moved away from the seat 570 such that bypass valve 560 is open and fluid may flow through the piston 567 via the opening 580 and the chamber 484. The opening 580 is sized to both set the threshold pressure difference at which the bypass valve 560 changes positions and to provide sufficient fluid flow through the open bypass valve 560 to ensure that the jet pump 500 provides an acceptable flow of pressurized fluid in the high pressure operating mode. The spring 575 biases the piston 567 to the open position.

In some embodiments, the bypass conduit 555 has a smaller diameter upstream of the bypass valve 560 than it does at the bypass valve 560. This change in diameter forms a shoulder or seat against which the piston 567 is held in the open position. This shoulder also reduces the available fluid surface area of the face of the piston 567 for the pressurized primary fluid to push against when the piston 567 is in the open position (FIGS. 9 and 10) as compared to the available fluid surface area of the face of the piston 567 when the piston 567 is in the closed position (FIGS. 12 and 13). This difference in the available fluid surface area of the face of the piston 567 helps to increase the pressure necessary to shift the piston 567 from the open position to the closed position (i.e., the "blow-off pressure") relative to the pressure need to hold or maintain the piston 567 in the closed position (i.e., the "maintenance pressure"). That is, the blow-off pressure is higher than the maintenance pressure. In a preferred embodiment, the ratio of blow-off pressure to the maintenance pressure is 6:1. This can be helpful for pressure washers including an idle-down mode in which the water pump speed is decreased when the water pump is not in use. Upon switching from the high pressure operating mode to the high flow operating mode, the rapid change in pressure on the face of the piston 567 is sufficient to reach the blow-off pressure and move the piston 567 to the closed position, even for pressure washers including an idle-down mode. In a preferred embodiment, the outer diameter of the piston 567 is 0.484 inches (1.229 centimeters), the diameter of the bypass conduit 555 upstream of the bypass valve 560 (e.g., the narrow portion prior to the shoulder) is 0.187 inches (0.475 centimeter), and the diameter of the opening 580 is 0.073 inches (0.1854 centimeter).

As shown in FIGS. 9 and 10, in the high pressure operating mode, the force applied by the second stream of pressurized primary fluid (i.e., the stream in the bypass conduit 555) on the upstream face of the piston 567 is overcome by the force applied to the piston 567 by the spring 575, thereby moving the piston 567 away from the seat 570 to the open position. As shown in FIGS. 12 and 13, in the high flow operating mode, the force applied by the second stream of pressurized primary fluid on the upstream face of the piston 567 overcomes the force applied to the piston 567 by the spring 575, thereby moving the piston 567 to closed position against the seat 570. In some embodiments, in order for the bypass valve 560 to close when in the high flow operating mode, the combined effective flow area of the opening 580 and the restriction 515 is less than the effective flow area of an outlet downstream of the jet pump 500 (e.g., the effective flow area of the selected nozzle of the spray gun of the pressure washer). In some alternative embodiments, the bypass valve 560 is manually operated by a user input (e.g., via a switch or dial). In these embodiments, the manually operated bypass valve could be used to change between high flow and high pressure operating modes. In some embodiments, the bypass valve could be a two-position (e.g., open and close) valve including a mechanical user input accessible to the user external to the jet pump 500. In other embodiments, the bypass valve could be electrically actuated (e.g., a solenoid valve) to either the open or closed position and biased to the opposite position, or electrically actuated to both the open and closed positions. An electrically actuated bypass valve could be controlled by an electrical user input (e.g., button, switch, touchpad, touchscreen, or other appropriate actuator) located at various locations (e.g., on the jet pump 500, on the pressure washer, on the spray gun, etc.). The electrical user input could communicate with the electrically actuated bypass valve via wires or wirelessly. Accordingly, for embodiments including manually operated bypass valves, nozzles of some effective flow areas would be able to be used with the spray gun with the pressure washer operating in either the high flow operating mode or the high pressure operating mode.

As shown in FIGS. 12 and 13, in the high flow operating mode, pressurized primary fluid enters the jet pump 500 via the primary fluid inlet 505. The pressurized primary fluid flows through the primary fluid chamber 535 and into the bypass conduit 555 where the force applied by second stream on the upstream face of the piston 567 causes the bypass valve 560 to move to the closed position, thereby closing the bypass conduit 555 and preventing the flow of pressurized primary fluid past the bypass valve 560.

With the bypass valve 560 closed, the pressurized primary fluid flows through the primary fluid chamber 535 and through the primary fluid nozzle 510. The restriction 515 is the location where the diameter of the passage through the primary fluid nozzle 510 is at its minimum. In some embodiments, the primary fluid nozzle 510 includes a converging portion upstream of the restriction 515 where the diameter of the passage narrows in the direction of fluid flow towards the restriction 515 and a diverging portion downstream of the restriction 515 where the diameter of the passage widens in the direction of fluid flow. In other embodiments, the diverging portion is omitted and fluid exits the nozzle at the restriction 515 (as shown in FIGS. 9-13). In some embodiments, the restriction 515 defines an annular aperture. The pressurized primary fluid exits the primary fluid nozzle 510 into the mixing chamber 520. In some embodiments, the primary fluid nozzle 510 extends into the mixing chamber.

The restriction 515 creates a high velocity jet of pressurized primary fluid that exits the primary fluid nozzle 510 to the mixing chamber 520. The restriction 515 converts pressure to velocity. The high velocity jet of pressurized primary fluid creates a vacuum or low pressure zone in the mixing chamber 520 through a Bernoulli or Venturi effect or a combination of the two. The vacuum or low pressure zone and/or the pressure differential between the low pressure zone and the secondary fluid made available via the secondary fluid inlet 530 is sufficient to pull secondary fluid into the mixing chamber 520 through the secondary fluid inlet 530. Also, the check valve 557 is opened. Once in the mixing chamber 520, the secondary fluid is entrained with the pressurized primary fluid to form a combined high-volume fluid stream or flow which has a greatly increased volume of flow as compared to the pressurized primary fluid on its own. The high velocity jet of pressurized primary fluid contacts the secondary fluid pulled into the mixing chamber 520, thereby transferring kinetic energy to the secondary fluid. In this way, the pressurized primary fluid entrains the secondary fluid to create the combined high-volume fluid flow or stream. This combined high-volume fluid stream flows out of the mixing chamber 520 to exit the jet pump 500 through the fluid outlet 525

Figure 11:
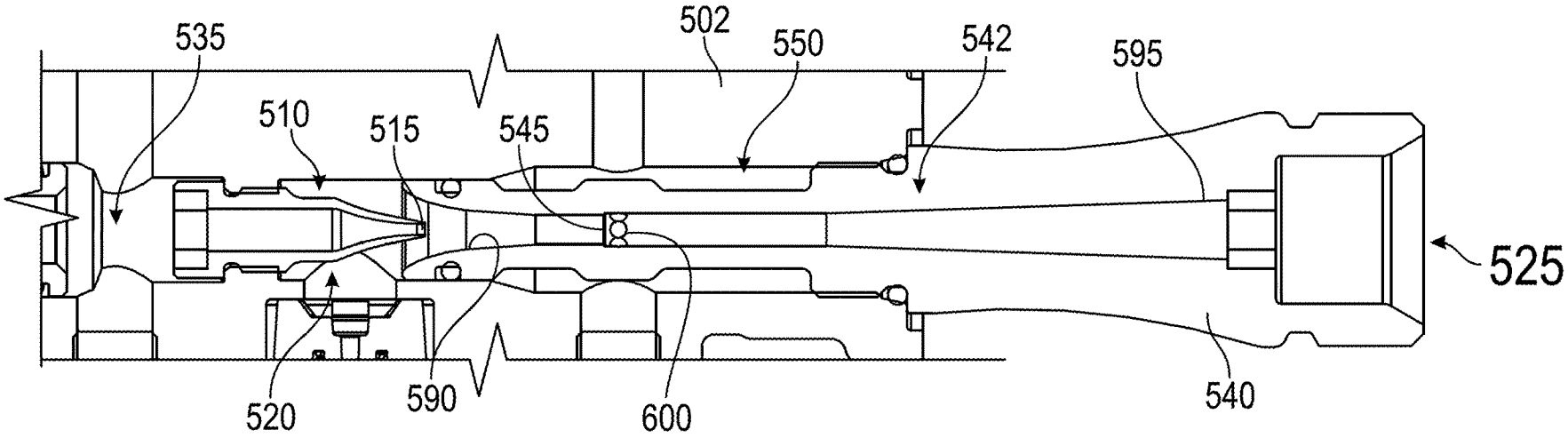
FIG. 11 is a detail view of another portion of the flow multiplier of FIG. 9.

As shown in FIG. 11, the outlet conduit 540 includes the outlet passage 542 that fluidly couples the mixing chamber 520 to the fluid outlet 525. The outlet conduit 540 defines a bell mouth or converging portion 590 at the entrance to the outlet passage 542. The diameter of the bell mouth 590 decreases in the direction of fluid flow. The bell mouth 590 efficiently directs the combined high-volume fluid stream into the outlet passage 542 from the mixing chamber 520. The outlet conduit 540 also defines a diffuser 595. The diameter of the diffuser 595 increases in the direction of fluid flow. The diffuser 595 converts velocity to pressure, thereby increasing the pressure and decreasing the velocity of the combined high-volume fluid stream prior to the fluid stream exiting the jet pump 500 through the fluid outlet 525.

The step 545 has the minimum diameter of the outlet passage 542. The diameter of the outlet passage 542 downstream of the step 545 (e.g., an exit portion diameter) is greater than the diameter at the step 545. One or more apertures or openings 600 (e.g., multiple opening arranged around the circumference of the outlet passage 542) extend from the annular chamber 550 to the outlet passage 542. The openings 600 are located downstream of the step 545. The increased diameter of the outlet passage 542 downstream of the step 545 helps to minimize the turbulence or other interference that results from the second stream of pressurized fluid entering the outlet passage 542 through the openings 600 when in the high pressure operating mode. The step 545 is structured as a venturi for chemical injection, as will be described in more detail below. Also, the step 545 creates a venturi-effect in the high flow operating mode and the low pressure zone downstream of the step is believed to help move the piston 567 to the closed position when transitioning from the high pressure operating mode to the high flow operating mode.

Referring to FIG. 12, the chemical inlet 565 allows a chemical (e.g., soap, polish, spot-free rinse, herbicide, detergent, etc.) to be added to the combined high-volume fluid stream. The chemical inlet 565 is fluidly coupled to a chemical container, source, or reservoir. In some embodiments, as shown in FIG. 1, the chemical container 566 is a component of the pressure washer 110 and fluidly coupled by a supply conduit 568 to the chemical inlet 565. In other embodiments, the chemical container is coupled to the spray gun (e.g., chemical container 720 of spray guns 700, 740, 750). The chemical inlet 565 is also fluidly coupled to the annular chamber 550 via a chemical passage 569 formed in the seat 570. A check valve 571 selectively closes the chemical inlet 565. The check valve 571 is biased to the closed position and opens when a sufficient pressure differential exists across the check valve 571 (e.g. between the annular chamber 550 and the chemical container). In some embodiments, the chemical inlet 565 is fluidly coupled to the bypass conduit 555 downstream of the bypass valve 560. When the back pressure on the jet pump 500 is below a chemical threshold pressure, the step 545 functions as venturi and creates a low pressure zone downstream of the step 545. This low pressure zone is sufficient to open the check valve 571 and draws chemicals from the chemical container, through the chemical inlet 565 into the annular chamber 550, through the openings 600 into the outlet passage 542 where the chemicals are added to the combined high-volume fluid stream. When the back pressure on the jet pump 500 is above the chemical threshold pressure, the low pressure zone is not created and chemicals are not drawn from the chemical container. In some embodiments (e.g., as shown in FIG. 1), an on/off chemical flow control valve 572 is fluidly coupled between the chemical container 566 and the chemical inlet 565. In some embodiments, a restriction or other metering device is fluidly coupled between the chemical container and the chemical inlet 565. In some embodiments, one or more additional chemical containers contain different chemicals than the first reservoir. The user may select among the containers by actuating a selector valve that fluidly couples one of the containers to the appropriate supply conduit. The additional containers may be coupled to the spray gun or a component of the pressure washer. In some embodiments, the chemical threshold pressure is 350 psi (2.413 MPa). In other embodiments, the chemical threshold pressure is different (e.g. 300 psi (2.068 MPa), 325 psi (2.241 MPa), 375 psi (2.586 MPa), etc.). The concentration of the active ingredients in the chemicals may need to be optimized for compatibility with the high flow operating modes to achieve the same output concentration of chemicals-to-water as found in conventional chemical injection systems. One advantage of the jet pump 500 is that the user may easily switch between the various operating modes (e.g., high pressure operating mode, high flow operating mode with no chemicals, high flow operating mode with chemicals) by changing the back pressure at the jet pump 500. The back pressure can be changed by changing the effective flow area of the spray gun (e.g., changing the position of a turret nozzle, changing individual nozzles, adjusting a variable nozzle, changing the spray gun, adjusting a restriction downstream of the jet pump, etc.). The user may switch between different spray patterns and output fluid flows simply by changing the selected nozzle (or adjusting the variable nozzle or changing spray guns). For example, a high pressure nozzle (e.g., a 0° nozzle or a 25° fan) can be selected for high pressure pressure-washing applications like cleaning siding and then a high flow nozzle (with or without adding chemicals) can be selected for high flow tasks like cleaning second story windows or washing a car. The user is able to switch between tasks directly at the spray gun, using a flow control valve to start and stop the fluid flow as needed and changing the nozzle to select the appropriate operating and chemical mode, rather than having to make a change at the body of the pressure washer. This can simply the process of changing between tasks and reduce the time needed to switch between tasks (e.g., pressure washing, rinsing, flushing, soaping, spot-free rinsing, etc.).

Figure 14:
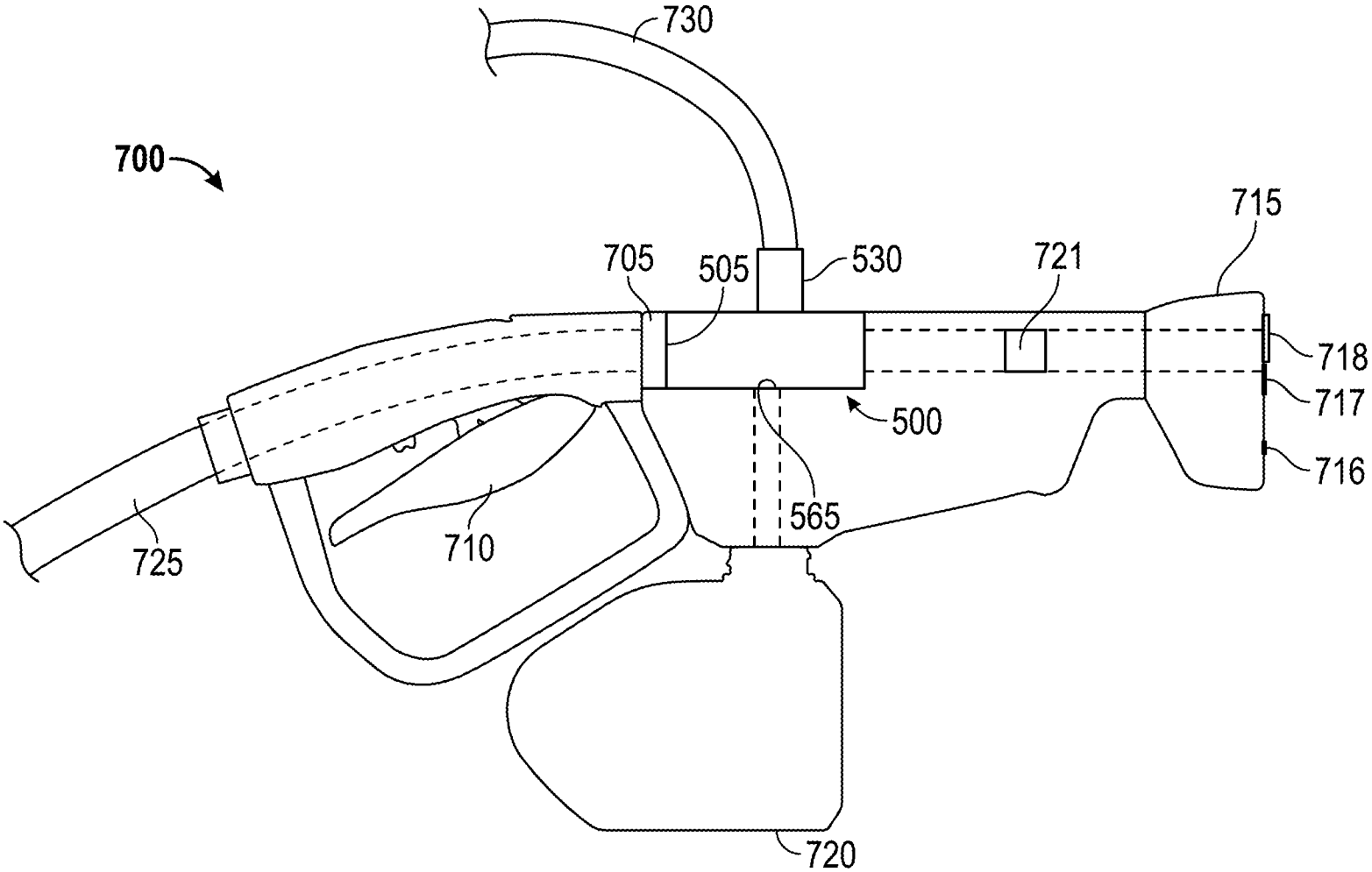
FIG. 14 is a schematic view of a spray gun, according to an exemplary embodiment.
Figure 15:
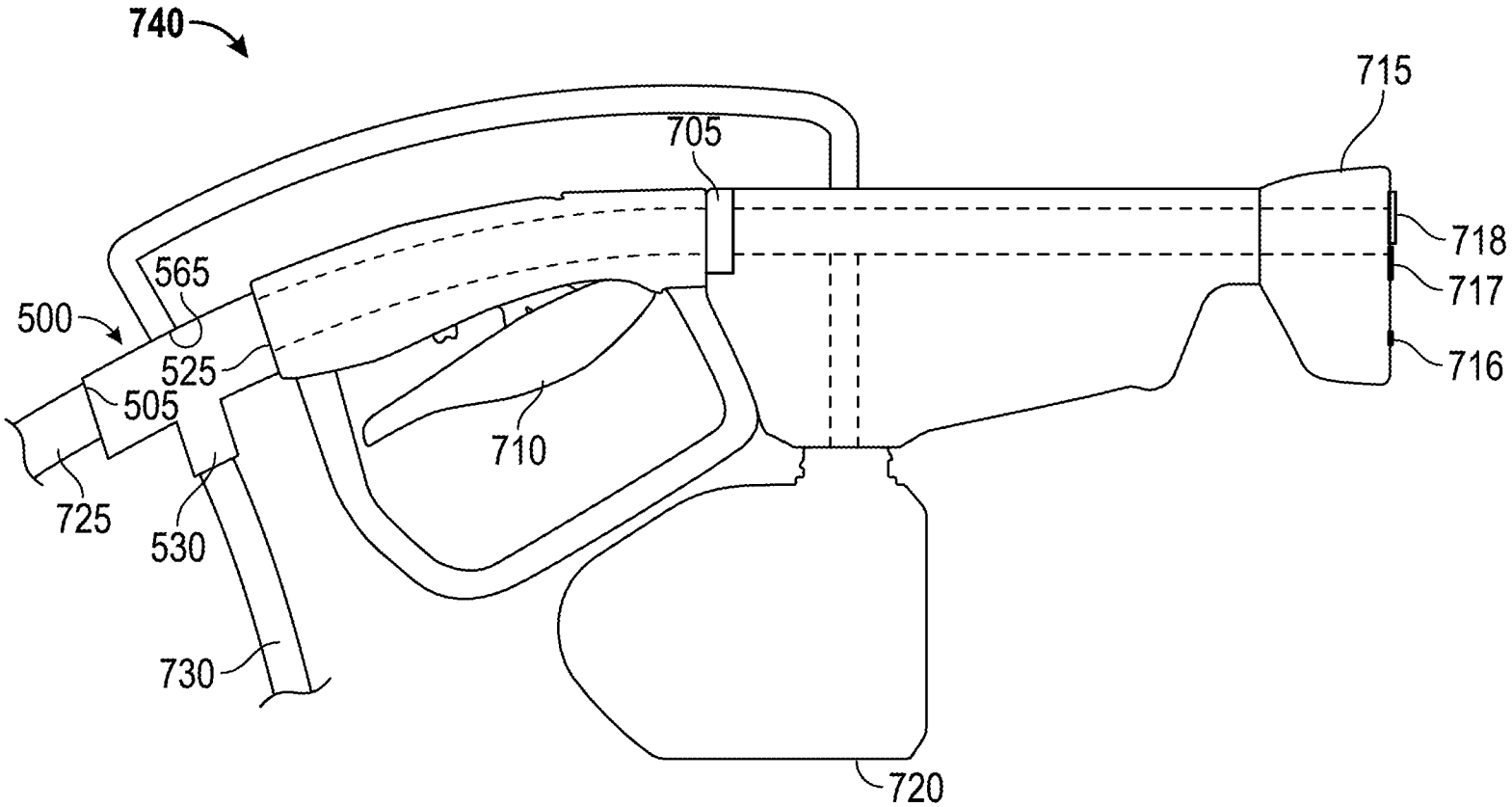
FIG. 15 is a schematic view of a spray gun, according to an exemplary embodiment.
Figure 16:
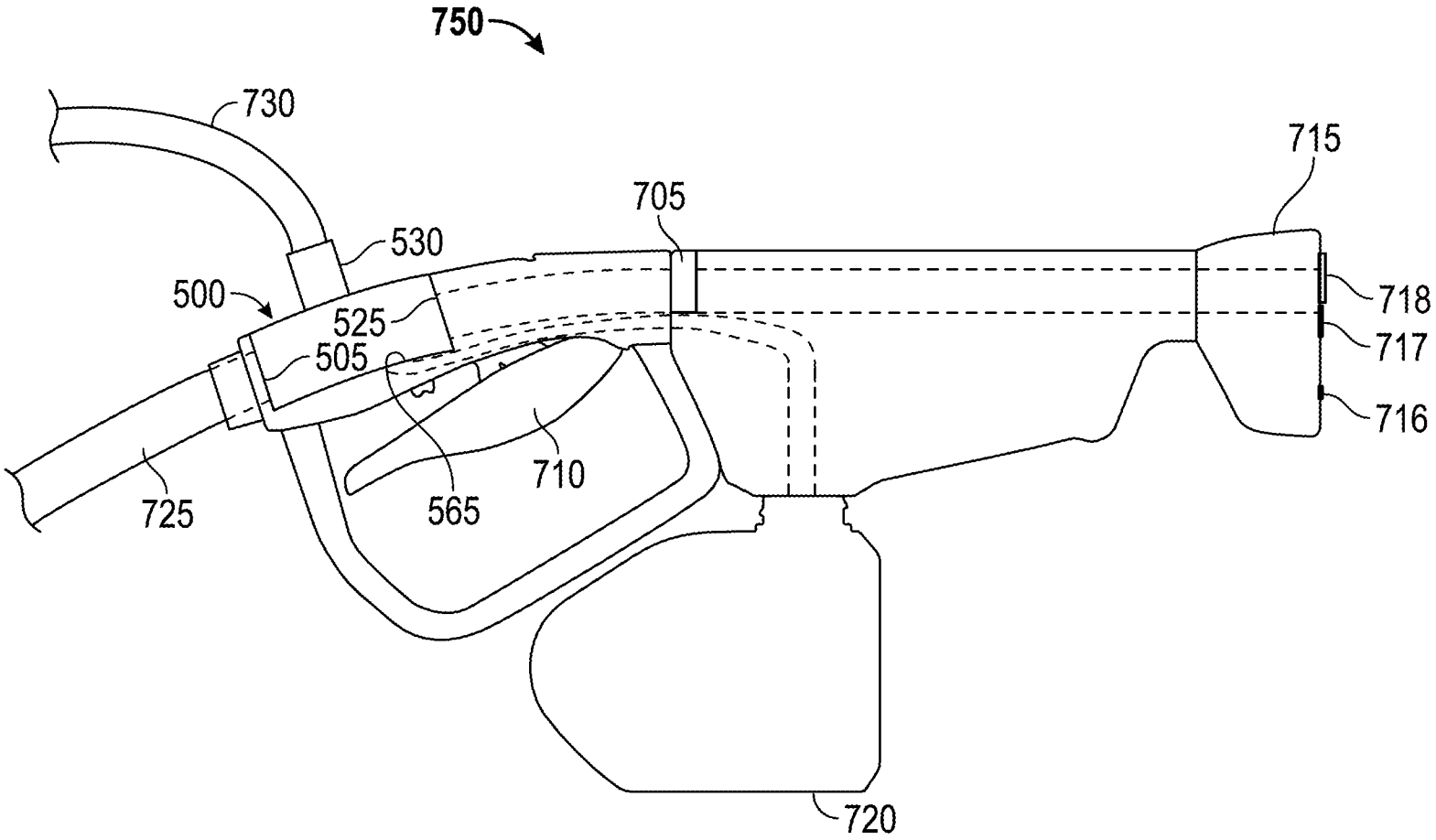
FIG. 16 is a schematic view of a spray gun, according to an exemplary embodiment.

Referring to FIGS. 14-16, spray guns 700, 740, and 750 for use with a pressure washer is illustrated. Each of the spray guns 700, 740, and 750 includes a fluid control valve or flow control valve 705 actuated by a trigger 710 (or other user-actuated input device) and a rotating turret 715, and the jet pump 500. In an open position, the flow control valve 705 allows fluid to exit the spray gun and in a closed position, prevents fluid from exiting the spray gun The rotating turret 715 includes multiple nozzles, each configured to provide a different spray pattern or output fluid flow. The user can rotate the rotating turret 715 to select one of the multiple nozzles for use. When the spray gun 700 is fluidly coupled to the outlet of a pressure washer (e.g., the fluid outlet 525), the effective flow area of the selected nozzle creates the back pressure at the jet pump 500. As explained above, the back pressure at the jet pump 500 controls whether the jet pump 500 is in the high flow operating mode or the high pressure operating mode and within the high flow operating mode controls whether chemicals are added or not added.

For example, in some embodiments, the rotating turret 715 includes a first nozzle 716 having a first effective flow area that creates a relatively high back pressure at the jet pump 500, thereby implementing the high pressure operating mode, a second nozzle 717 having a second effective flow area larger than the first effective flow area that creates a relatively low back pressure above the threshold chemical pressure at the jet pump 500, thereby implementing the high flow operating mode and not allowing chemicals to be added to the combined high-volume fluid stream, and a third nozzle 718 having a third effective flow area larger than the second effective flow area that creates a relatively low back pressure below the threshold chemical pressure at the jet pump 500, thereby implementing high flow operating mode and adding chemicals to the combined high-volume fluid stream. The rotating turret 715 allows the user to switch between different spray patterns and output fluid flows simply by changing the selected nozzle. For example, a high pressure nozzle (e.g., a 0° nozzle or a 25° fan) can be selected for high pressure pressure-washing applications like cleaning siding and then a high flow nozzle (with or without adding chemicals) can be selected for high flow tasks like cleaning second story windows or washing a car. The user is able to switch between tasks directly at the spray gun 700, using the flow control valve 705 to start and stop the fluid flow as needed and the rotating turret 715 to select the appropriate operating and chemical mode.

In some embodiments, the rotating turret 715 is replaced with a fluid outlet having a fitting capable of receiving removable nozzles one at a time (e.g., similar to spray gun 118 and nozzles 265 and 270 described above). Multiple removable nozzles each having different effective flow areas are available to switch between different spray patterns and output fluid flows simply by changing the selected nozzle, like with the rotating turret 715.

A chemical container 720 is secured to body of the spray gun 700 and is fluidly coupled to the jet pump 500 at the chemical inlet 565. In some embodiments, the chemical container 720 is removably secured to the body of the spray gun 700 so that it can be removed and refilled or replaced as necessary.

As shown in FIGS. 15 and 16, the jet pump 500 may be located upstream of the flow control valve 705. The flow control valve 705 is designed to handle fluid output associated with the high pressure and the high flow operating modes. As shown in FIG. 15, the jet pump 500 may be removably attached to the body of the spray gun 740. As shown in FIG. 16, the jet pump 500 may be integrated into the spray gun 750.

As shown in FIG. 14, the jet pump 500 is integrated into the spray gun 700 and is located downstream of the flow control valve 705, such that flow control valve 705 controls the flow of pressurized primary fluid to the fluid inlet 505 of the jet pump 500. The flow control valve 705 is designed to handle the maximum fluid output of the pressure washer. In these embodiments, the spray gun 700 also includes a pressure relief valve 721 or other shutoff valve to prevent secondary fluid from flowing out of the spray gun, even when the flow control valve 705 is closed. The pressure relief valve 721 is configured to open at a threshold pressure (e.g. 100 psi (689.5 kPa)) above typical water supply pressures (e.g., 30 psi (206.8 kPa)) and to close at pressures below the threshold pressure to prevent secondary fluid from continually flowing out of the spray gun 700.

Referring to FIGS. 14-16, the primary fluid inlet 505 of the jet pump 500 is fluidly coupled to the outlet of the pressure washer (e.g., the fluid outlet 525) by a high pressure hose or conduit 725 and the secondary fluid inlet 530 is fluidly connected to a water source (e.g. a spigot connected to a municipal water supply or well) by a low pressure hose or conduit 730 (e.g., a garden hose). In some alternative embodiments where the jet pump 500 is used with a garden hose booster system (e.g., the booster water spraying systems described in U.S. application Ser. No. 12/411,139, filed on Mar. 25, 2009 and published as US 2010/0243086, the garden hose booster water pump systems described in U.S. application Ser. No. 12/502,798, filed Jul. 14, 2009 and patented as U.S. Pat. No. 8,439,651, and the garden hose booster systems described in U.S. application Ser. No. 12/787,282, filed May 25, 2010 and published as US 2011/0290827, all of which are incorporated herein by reference in their entireties), the primary fluid inlet 505 of the jet pump 500 is fluidly coupled to the outlet of the garden hose booster system by a low pressure hose or conduit (e.g., a garden hose) and the secondary fluid inlet 530 is fluidly connected to a water source (e.g. a spigot connected to a municipal water supply or well) by a low pressure hose or conduit (e.g., a garden hose). The hoses 725 and 730 may be attached to each other (e.g., by clamps, straps, ties, etc. or co-molded, co-extruded, or otherwise formed as a single hose having two flow passages or paths). The water source supplies secondary fluid to the jet pump 500 and primary fluid to the water pump (e.g. water pump 116) of the pressure washer. For example a tee fitting may be provided at the inlet to the water pump so that water from the water source is available to both the water pump and the secondary fluid inlet 530. In some embodiments, the spray gun 700 also includes a second or low pressure trigger that actuates a second on/off flow control valve to fluidly connect the secondary fluid hose to a fluid output (e.g., the selected nozzle on the rotating turret 715) to provide a flow of the secondary fluid (e.g., a "garden hose" flow) for low pressure and low flow tasks.

Figure 17:
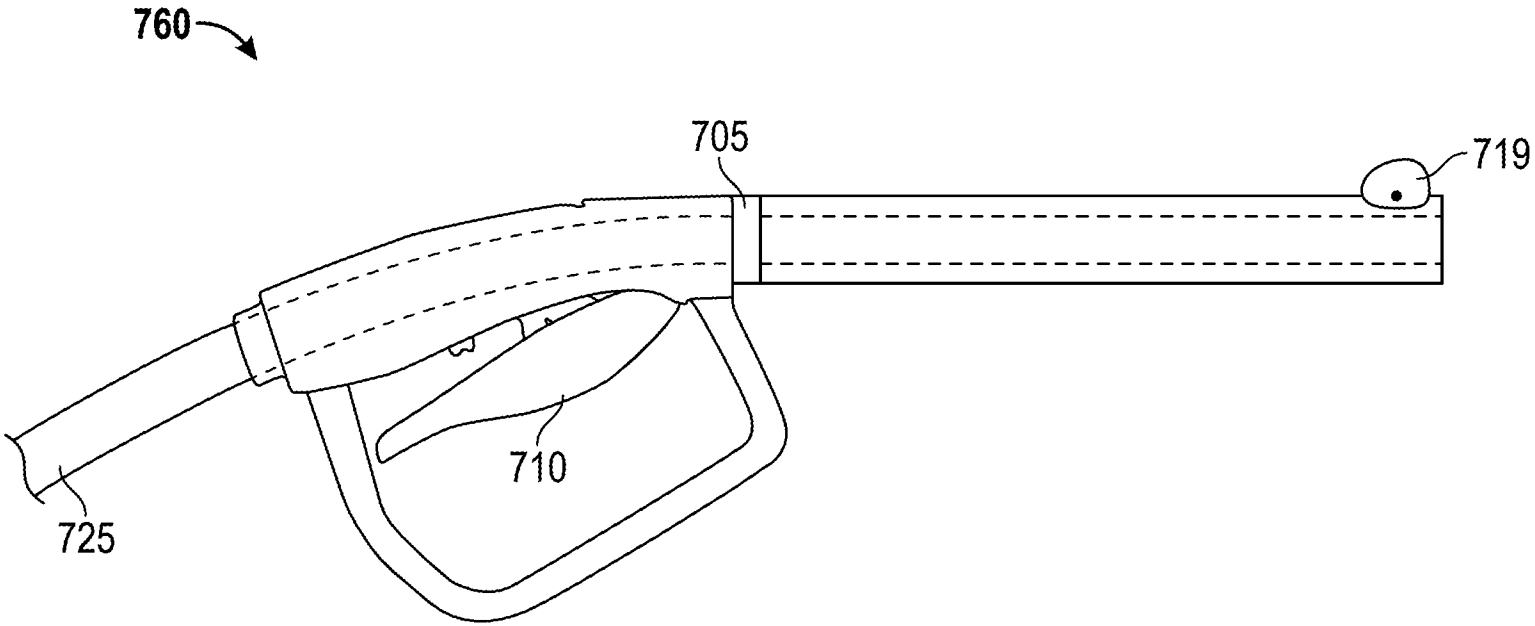
FIG. 17 is a schematic view of a spray gun, according to an exemplary embodiment, in a first configuration.
Figure 18:
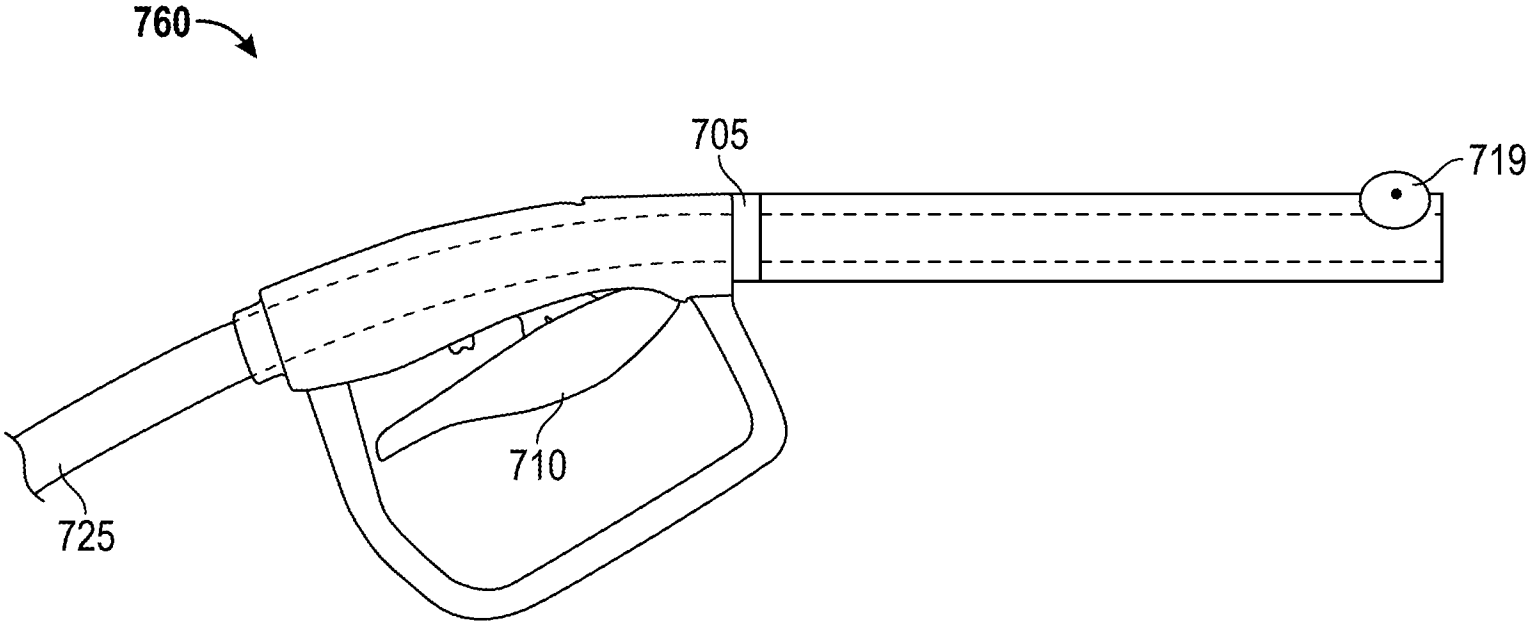
FIG. 18 is a schematic view of the spray gun of FIG. 17, in a second configuration.

Referring to FIGS. 17-18, a spray gun 760 is illustrated. The spray gun 760 includes an adjustable or variable nozzle 719 for varying the effective flow area of the spray gun instead of multiple nozzles as shown in FIGS. 14-16. As shown in FIG. 17, in a first configuration of the variable nozzle 719, the effective flow area is relatively large and implements a high flow operating mode. As shown in FIG. 18, in a second configuration of the variable nozzle 719, the effective flow area is relatively small and implements a high pressure operating mode. In some embodiments, the variable nozzle 719 is infinitely variable. In some embodiments, the variable nozzle 719 has a number of preset positions corresponding to different effective flow areas.

Figure 19:
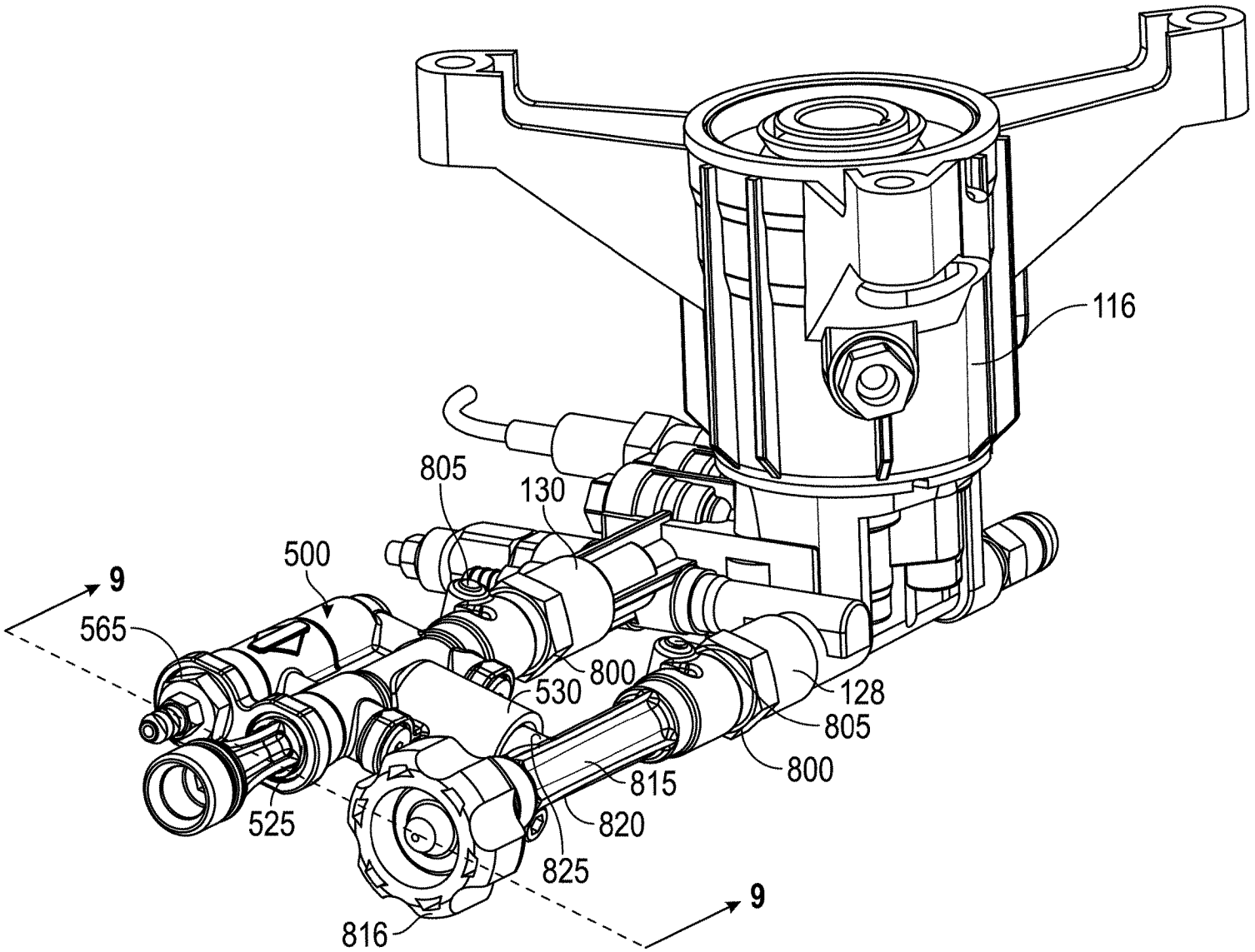
FIG. 19 is a perspective view of an integrated flow multiplier and water pump assembly, according to an exemplary embodiment.

As shown in FIGS. 9-13 and 19, the jet pump 500 can also be integrated with a water pump 116. The primary fluid inlet 505 is secured to the pump outlet 130. For example, as shown in FIG. 19, a threaded coupling 800 screws into the pump outlet 130 and a pinch fastener 805 (e.g., a self-tapping pinch bolt) provides a radial clamping load. As shown in FIG. 9, an o-ring or gasket 810 seals the connection between the fluid inlet 505 and the pump outlet 130. A tee fitting 815 includes a primary fluid conduit 820 secured to the pump inlet 128 and a secondary fluid conduit 825 that is secured to the secondary fluid inlet 530. For example, the primary fluid conduit 820 is secured to the pump inlet 128 with a threaded coupling 800, pinch fastener 805, and o-ring 810 similar to those used to secure the primary fluid inlet 505 to the pump outlet 130. For example, as shown in FIG. 19, the secondary fluid conduit 825 is secure to the secondary fluid inlet 530 by a flange joint 830 and fastener 835 (e.g., a self-tapping screw). As shown in FIG. 9, an o-ring or gasket 840 seals the connection between the secondary fluid conduit 825 and the secondary fluid inlet 530. The tee fitting 815 also includes an inlet 816 configured to be connected to a fluid source. In some embodiments, the inlet 816 includes a garden-hose or other low pressure fitting.

In some embodiments, a common or shared pump housing encloses the jet pump 500 and the pumping mechanism of the water pump 116. In some embodiments, this pump housing includes a mounting structure for attaching the water pump 116 to a prime mover. In some embodiments, the jet pump 500 and at least a portion of the pumping mechanism of the water pump 116 (e.g., a cylinder or piston block, a housing, a crankcase, etc.) are formed as a single (e.g., integral, unitary) component (e.g., a single casting). A flow multiplier (e.g. the jet pump 500) "integrated" with or "integral" to a water pump (e.g., the water pump 116) is a single unitary component in which the flow multiplier and water pump share a common housing enclosing the flow multiplier and the pumping mechanism of the water pump and/or in which the flow multiplier and at least a portion of the pumping mechanism of the water pump (e.g., a cylinder or piston block, a housing, a crankcase, etc.) are formed as a single (e.g., integral, unitary) component (e.g., as a single casting, as a single molded component, etc.).

Figure 20:
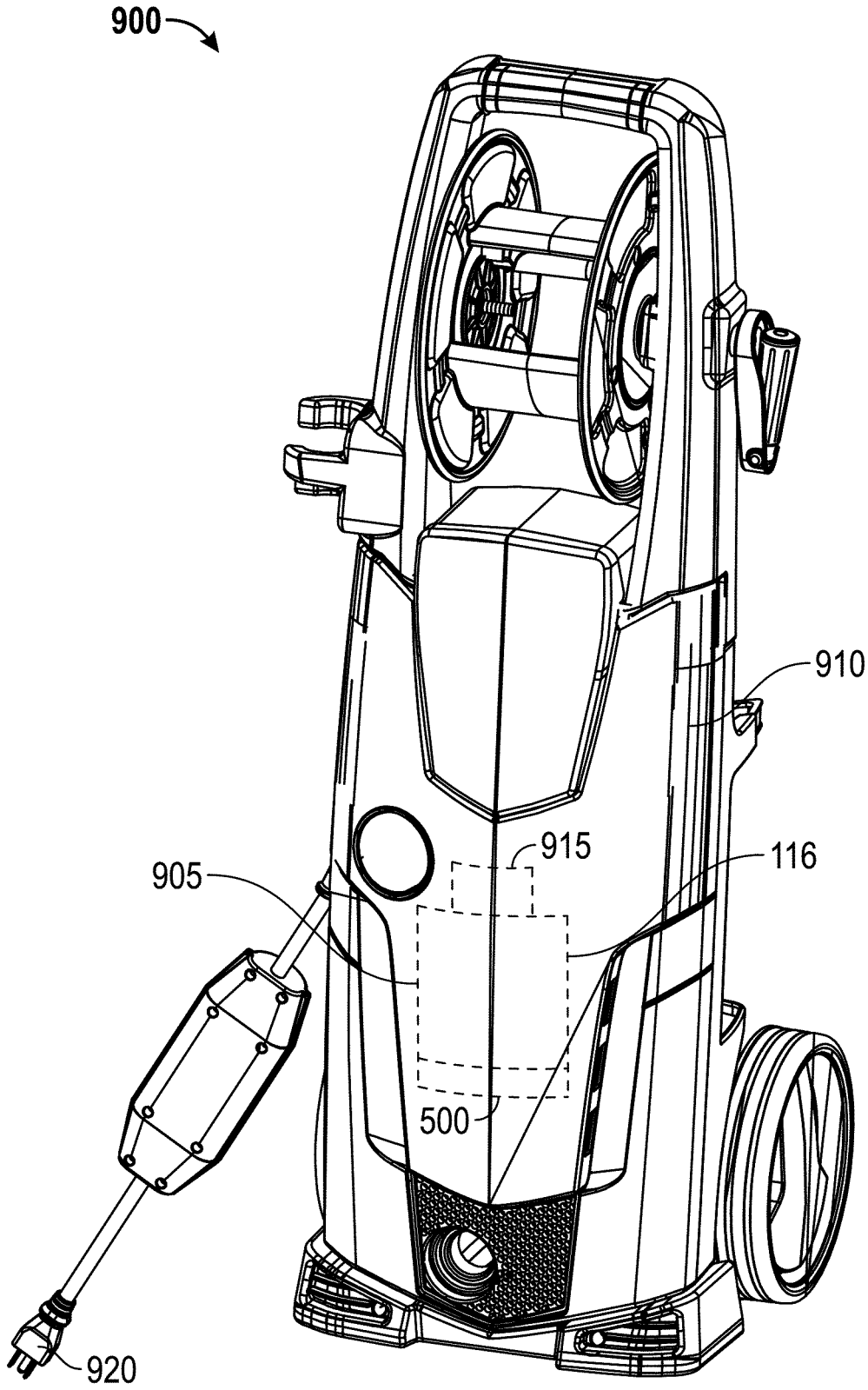
FIG. 20 is a perspective view of an electric pressure washer, according to an exemplary embodiment.

Referring to FIG. 20, an electric pressure washer 900 is illustrated, according to an exemplary embodiment. The jet pump 500 is integrated with the water pump 116 to form a flow multiplier and water pump assembly 905. In the illustrated embodiment, the flow multiplier and water pump assembly is an internal component of the electric pressure washer 900 located entirely within a housing 910 of the electric pressure washer 900 and is therefore not visible to the user during normal operation of the pressure washer. In some embodiments, the flow multiplier and water pump assembly 905 may be an external component of the electric pressure washer 900 (i.e., located wholly external to or outside of the housing 910 and visible to the user during normal operation of the pressure washer). In other embodiments, at least a portion (e.g., at least a portion of one or more of the primary fluid inlet 505, the fluid outlet 525, the secondary fluid inlet 530, and the chemical inlet 565) extends through the housing 910 and is visible to the user during normal operation of the pressure washer. The electric pressure washer 900 also includes an electric motor 915 as the prime mover and a power cord 920 for supplying electricity to the electric motor 915. An actuator (e.g., switch, button, touchpad, touchscreen, or other appropriate user input device) may be actuated by the user to activate or deactivate the electric motor 915 and thereby activate or deactivate the flow multiplier and water pump assembly 905. In some embodiments, the flow multiplier and water pump assembly 905 is an internal component of a gas pressure washer (e.g., located within a housing or shroud of a gas pressure washer). The flow multiplier and water pump assembly 905 may be considered to a single water pump including both the jet pump 500 and a primary pumping mechanism (e.g., water pump 116). Such a single water pump could be used in place of other types of pumps that are able to provide varying flow rates (e.g., variable displacement pumps, variable stroke pumps, variable speed pumps, etc.).

Figure 21:
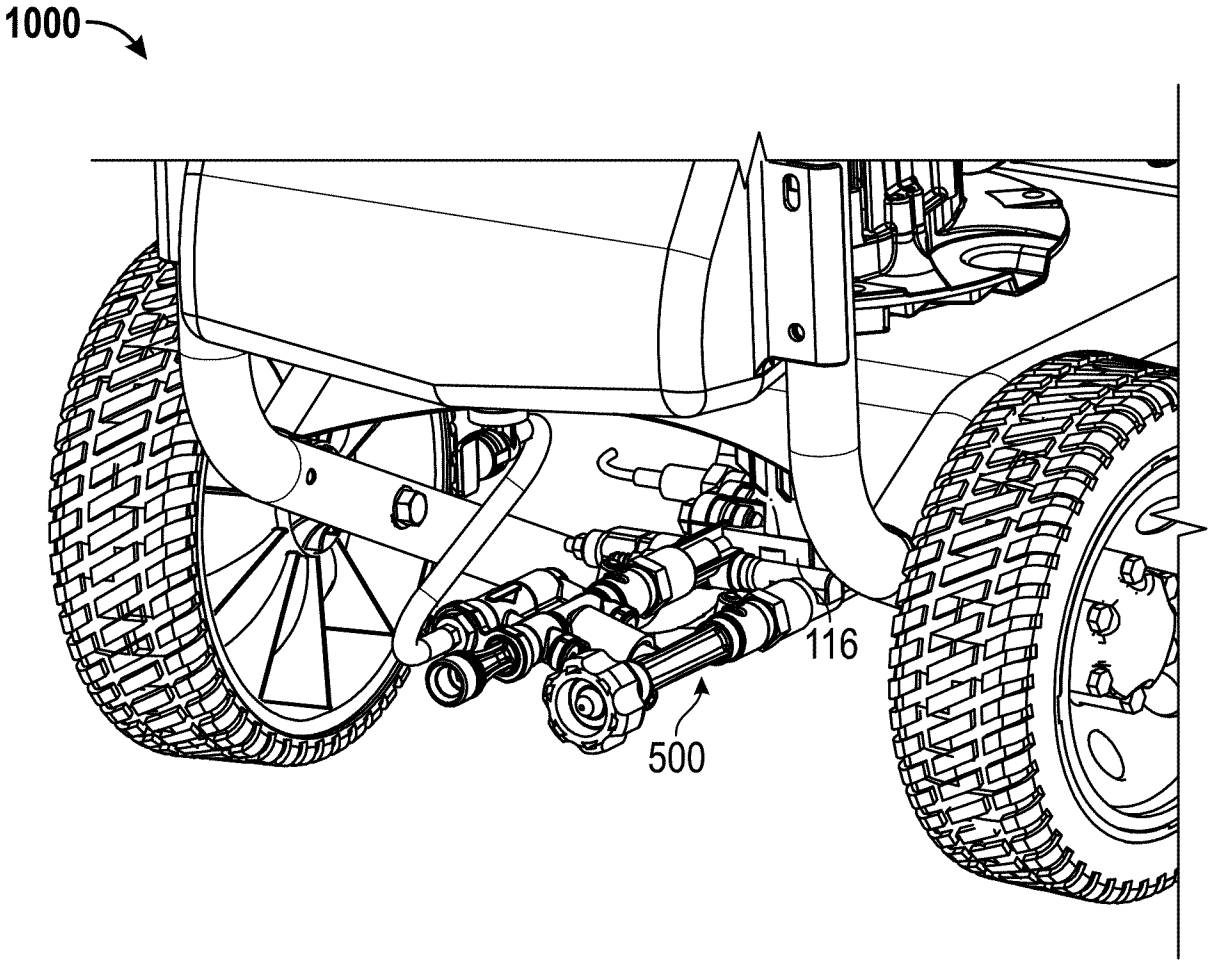
FIG. 21 is a perspective view of a portion of pressure washer, according to an exemplary embodiment.

As shown in FIG. 21, in some embodiments, the jet pump 500 can be an external component of a pressure washer 1000 so that it is visible to the user during normal operation of the pressure washer. The flow multiplier can be a component of the pressure washer 1000 as sold by the manufacturer. The jet pump 500 can also be later installed by the user onto the pressure washer 1000. In this way, the user can change an existing pressure washer into a pressure washer capable of providing high flow and high pressure operating modes and chemical injection. The jet pump 500 is therefore attachable to and detachable from the pressure washer 1000.

In some embodiments, the jet pump 500 is integrated within an output conduit or hose that fluidly couples the pump outlet (e.g., pump outlet 130) to a spray gun.

When the jet pump 500 is not secured to a spray gun (e.g., pressure washers 900 and 1000), a single output hose or conduit having a single fluid passage or path may be used to fluidly couple the fluid outlet 525 to a spray gun. Preferably, this output hose is designed to handle both the high pressure and the high flow operating modes (e.g., a high pressure hose providing sufficient flow capacity for the high flow operating modes).

The jet pump 500 can be sold separately from a pressure washer to allow the user to change an existing pressure washer into a pressure washer capable of providing high flow and high pressure operating modes and chemical injection. The jet pump 500 can be sold on its own or as part of a kit including the jet pump 500, a spray gun (e.g., the spray gun 700), and any hoses or conduits necessary to fluidly couple the jet pump 500 to the spray gun or to fluidly couple the pressure washer to the jet pump 500. A user may use such a kit to convert a standard or conventional pressure washer to a variable flow pressure washer by coupling the primary fluid inlet 505 of the jet pump 500 to the pump outlet 130 of the water pump 116 (e.g., by a conduit or hose, directly coupled, etc.), coupling the secondary fluid inlet 530 of the jet pump 500 to a supply conduit or hose configured to be coupled to a source of fluid, and coupling the fluid outlet 525 to an output conduit or hose or to a spray gun (e.g., the spray guns 740 and 760). The user may also couple the jet pump 500 to the body of the pressure washer (e.g., to the water pump 116, to frame 112, to the base plate 122, to the prime mover 114, etc.) or to a spray gun (e.g. the spray guns 740 and 760). The tee fitting 815 may be included in the kit so that a common fluid source is coupled to both the secondary fluid inlet 530 and the pump inlet 128 of the water pump 116.

The jet pump 500 is suitable for use with gas pressure washers (i.e., pressure washers having an internal combustion engine as the prime mover) and for use with electric pressure washers (i.e., pressure washers having an electric motor as the prime mover). Gas pressure washers typically have a higher rated output (e.g., in terms of pressure and/or flow rate that can be provided) than electrical pressure washers. The jet pump 500 allows the pressure washer to provide a high flow operating mode that would not otherwise be available from a standard or conventional pressure washer alone. At a minimum, pressure washers are rated at 100 psi (689.5 kPa). Pressure washers may be rated up to 4000 psi (27.58 MPa) and above. For example, for a gas pressure washer rated at 3000 psi (20.68 MPa) at 2.7 gpm (10.2 l/min), the jet pump 500 can provide a high flow operating mode producing 400 psi (2.758 MPa) at 5 gpm (18.9 l/min). For an electric pressure washer rated at 1700 psi (11.72 MPa) at 1.3 gpm (4.9 l/min), the jet pump 500 can provide a high flow operating mode producing 175 psi (1.207 MPa) at 4.7 gpm (17.8 l/min). The jet pump 500 about doubles the flow rate for a gas pressure washer and about quadruples the flow rate for an electric pressure washer.

Referring to FIG. 3A, in some embodiments, a pressure washer may include a water source pressure gage 1205. The water source pressure gage 1205 is fluidly coupled to the secondary fluid source to indicate if there is sufficient secondary fluid pressure at the secondary fluid inlet 230 to provide sufficient secondary fluid to successfully implement the high flow operating mode. When the secondary fluid pressure is too low (e.g., below a threshold), the secondary fluid source cannot provide sufficient secondary fluid to keep up with the needs of the flow multiplier 200 in the high flow operating mode. For example, this could happen when using a well with a low line pressure as the secondary fluid source. The water source pressure gage 1205 provides an indication to the user (e.g., a light, message, audible sound, or other user-perceptible indicator) that the secondary fluid pressure is sufficient to allow for the high flow operating mode.

In some embodiments, a pressure washer includes a frame, a prime mover supported by the frame and including a power takeoff, a water pump coupled to the power take off and including a pump inlet and a pump outlet, a supply conduit fluidly coupled to the pump inlet and configured to be coupled to a primary fluid supply, a flow multiplier including a mixing chamber having a fluid outlet, a primary fluid inlet fluidly coupled to the pump outlet, a primary fluid restriction downstream of the primary fluid inlet, a primary fluid nozzle downstream of the primary fluid restriction, the primary fluid nozzle extending into the mixing chamber and having a nozzle outlet located within the mixing chamber, and a secondary fluid inlet in fluid communication with the mixing chamber, a secondary fluid conduit fluidly coupled to the supply conduit and the secondary fluid inlet, a check valve along the secondary fluid conduit and located upstream of the secondary fluid inlet, the check valve configured to close the secondary fluid conduit in response to a mixing chamber pressure above a threshold pressure, a delivery conduit fluidly coupled to the fluid outlet, and a spray gun fluidly coupled to the delivery conduit downstream of the fluid outlet, the spray gun including at least two nozzles, the first nozzle having a first flow area and the second nozzle having a second flow area greater than the first flow area, the fluid exiting the spray gun through one of the at least two nozzles. In a high-pressure operating mode, primary fluid flows from the primary fluid source to the water pump through the supply conduit, is pressurized in the water pump, exits the water pump, enters the flow multiplier via the primary fluid inlet, passes through the primary fluid restriction to the primary fluid nozzle, exits the primary fluid nozzle outlet into the mixing chamber, exits the mixing chamber through the fluid outlet, passes through the delivery conduit to the spray gun, and exits the spray gun through the first nozzle, thereby causing the mixing chamber pressure to exceed the threshold pressure. In a high-flow operating mode, primary fluid flows from the primary fluid source to the water pump through the supply conduit, is pressurized by in the water pump, exits the water pump, enters the flow multiplier via the primary fluid inlet, passes through the primary fluid restriction to the primary fluid nozzle, and exits the primary fluid nozzle outlet into the mixing chamber and secondary fluid flows from the supply conduit, through the check valve, and into the mixing chamber through the secondary fluid inlet so that the secondary fluid is entrained with the primary fluid, resulting in a combined fluid flow that exits the mixing chamber through the fluid outlet, passes through the delivery conduit to the spray gun, and exits the spray gun through the second nozzle, thereby maintaining the mixing chamber pressure below the threshold pressure.

Figure 22:
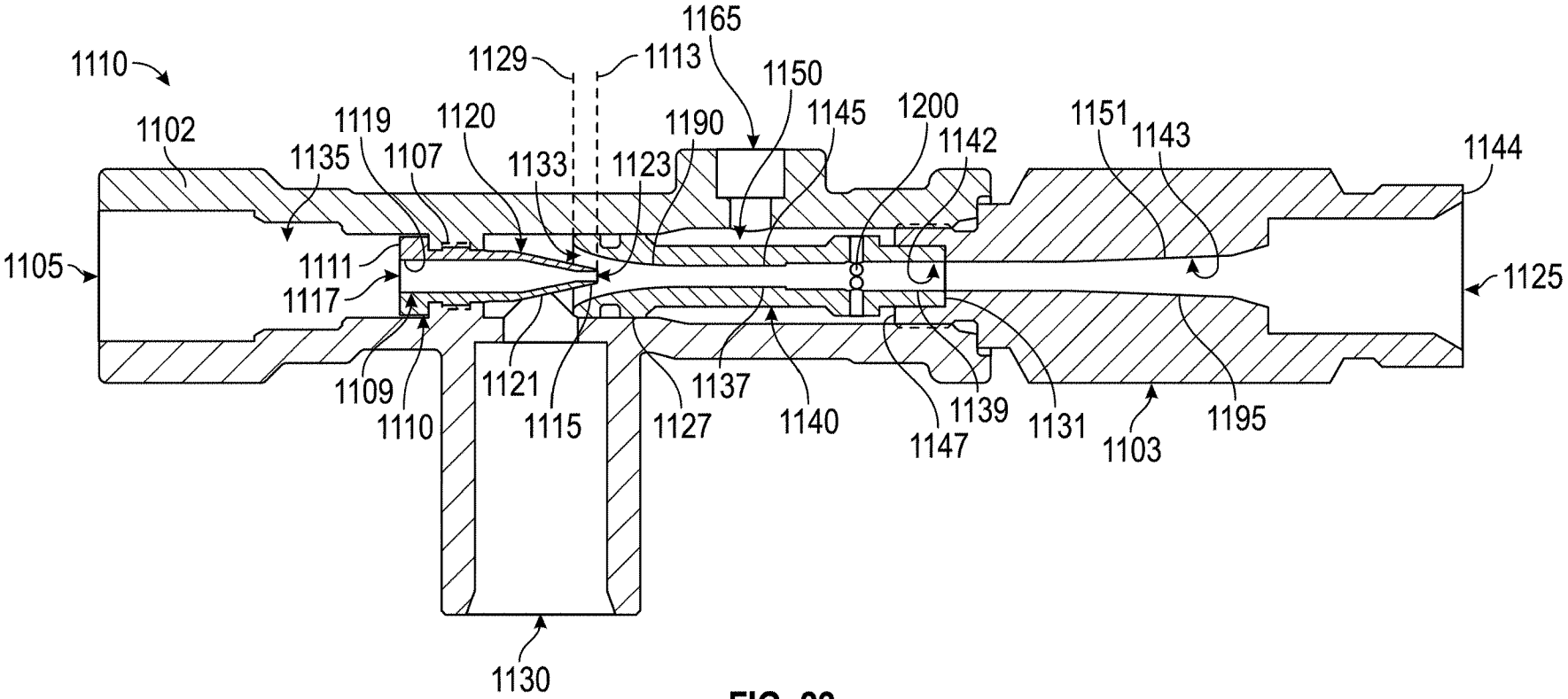
FIG. 22 is a sectional view of a flow multiplier, according to an exemplary embodiment.

Referring to FIG. 22, a flow multiplier or jet pump 1100 is illustrated according to an exemplary embodiment. Many features and uses of the jet pump 1100 are similar to those described above for flow multiplier 500. However, the jet pump 1100 does not include the bypass conduit 555 included in the jet pump 500. The jet pump 1100 includes a body 1102, a primary fluid nozzle 1110, a mixing conduit 1140, and an outlet conduit 1103. As described in more detail above, the jet pump 1100 is configured to operate in at least two different modes, a high pressure mode and a high flow mode, in response to the back pressure at the jet pump 1100.

The jet pump body 1102 includes a primary fluid inlet 1105 for receiving pressurized primary fluid from a water pump. The primary fluid inlet 1105 is fluidly coupled to a primary fluid chamber 1135 and a mixing chamber 1120. The nozzle 1110 is attached to a nozzle mount 1107 located between the primary fluid chamber 1135 and the mixing chamber 1120 to fix the nozzle 1110 at a nozzle location. The jet pump body 1102 also includes a secondary fluid inlet 1130 fluidly coupled to the mixing chamber 1120, and a chemical inlet 1165 fluidly coupled to the mixing chamber 1120.

The nozzle 1110 including a nozzle passage 1109 that extends from a first (entrance) end 1111 to a second (exit) end 1113 of the nozzle 1110. The first end 1111 includes an entrance opening 1117. The entrance opening 1117 provides access to an entrance portion 1119 of the nozzle passage 1109 having a substantially constant diameter. The diameter of the nozzle passage 1109 decreases or narrows along a converging portion 1121 and reaches a minimum diameter at a primary fluid restriction 1115. The primary fluid restriction 1115 extends to an exit opening 1123 in the second end of the nozzle. As illustrated, the diameter of the exterior surface of the nozzle 1110 decreases along with the converging section and primary fluid restriction 1115 of the nozzle passage. A nozzle diameter ($D_n$) is defined as the outer diameter of the nozzle 1110 at the second end 1113.

The mixing conduit 1140 is positioned within the mixing chamber 1120. For example, the mixing conduit 1140 may be inserted into the mixing chamber 1120 through the open or downstream end of the mixing chamber 1120. The mixing conduit 1140 is fixed at a mixing conduit location 1127. The mixing conduit 1140 may be directly secured to the jet pump body 1102 or indirectly secured to the jet pump body 1102 (e.g., the mixing conduit 1140 is secure to the outlet conduit 1103 (e.g., by a threaded connection) and the outlet conduit 1103 is secured to the jet pump body 1102 (e.g., by a threaded connection)). The mixing conduit 1140 includes a mixing passage 1142 that extends from a first (entrance) end 1129 to a second (exit) end 1131 of the mixing conduit 1140. The first end 1129 includes an entrance opening 1133. The mixing passage 1142 narrows from the entrance opening 1133 through a bellmouth or converging portion 1190 to a mixing portion 1137 having a mixing conduit diameter ($D_m$). The mixing conduit diameter $D_m$ is the minimum diameter of the mixing passage 1142. The mixing portion 1137 ends at a step 1145 at which the diameter of the mixing passage 1142 increases. A chemical inject portion 1139 of the mixing passage 1142 extends from the step 1145 to an exit opening 1141 in the second end 1131 of the mixing conduit 1140. One or more chemical injection ports or openings 1200 are formed in the mixing conduit 1140 between the step 1145 and the exit opening 1141. An annular chamber 1150 is formed between the exterior surface of the mixing conduit 1140 and a portion of the body 1102. The chemical inlet 1165 and the chemical injection ports 1200 are in fluid communication with the chamber 1150 so that chemicals may be added to the fluid flow through the mixing passage 1142 due a venturi effect caused by the step 1145 under certain operating conditions as explained in more detail above.

The outlet conduit 1103 is secured to the jet pump body 1102 at the downstream end of the mixing chamber 1120. The outlet conduit 1103 includes an outlet passage 1143 that extends from a first (entrance) end 1147 to a second (exit) end 1149 of the outlet conduit 1103. The outlet passage 1143 widens from an entrance portion 1151 through a diffuser section 1195 in which the diameter of the outlet passage 1143 increases as it approaches a fluid outlet 1125.

As described in more detail above, the jet pump 1100 is configured to operate in at least two different modes, a high pressure mode and a high flow mode, in response to the back pressure at the jet pump 1100. These two modes are intended to provide a user of a pressure washer incorporating the jet pump 1100 with more functionalities than a standard pressure washer operable only in a high pressure mode. The high flow mode not found in a standard pressure washer enables the user to perform extended reach, flushing, and rinsing tasks, (e.g., to clean second story windows, to wash away debris or rinse an object being cleaned, etc.) more effectively and efficiently than a standard pressure washer due to the increased or boosted output flow rate provided by the high flow operating mode relative to the single high pressure mode available in a standard pressure washer. In combination with this, the high pressure mode must provide an output flow rate at a sufficiently high pressure to perform typical high pressure tasks (e.g., cleaning by removing dirt, grime, stains from decks, driveways, siding, garage floors, etc.), so that the user still receives the expected high pressure mode functionalities of a standard pressure washer.

Applicant has discovered that the minimum acceptable performance level for the high flow operating mode is a flow rate of at least 3 gpm (11.4 l/min) at an output pressure of 100 psi (689.5 kPa). Identifying this minimum performance level for the high flow operating mode was driven by user requests for a pressure washer capable of providing extended reach with the output flow. Users were particularly concerned with the ability to clean windows and siding on the second story of a home. Applicant conducted appropriate testing and discovered that minimum acceptable performance level for the high flow operating mode is a flow rate of at least 3 gpm (11.4 l/min) at an output pressure of 100 psi (689.5 kPa). This minimum acceptable performance level provides for the user-desired extended reach functionality and accounts for practical limitations on the amount of flow multiplication possible with the jet pump due to variations in water supply pressures typically available from the common fluid supply to a user (e.g., municipal water supply or well) to supply input fluid to both the water pump and the secondary fluid inlet of the jet pump. Applicant also has discovered that the maximum acceptable pressure drop caused by the jet pump in the high pressure operating mode is 500 psi (3.447 MPa) (i.e., the output pressure from the jet pump can be no more than 500 psi (3.447 MPa) less than the output pressure from the water pump of the pressure washer).

Applicant designed jet pump 1100 to meet these two critical operational characteristics when the jet pump 1100 is used in combination with water pumps of varying capacity in terms of output flow rate from the water pump (e.g., various pumps with capacities of between 1.25 gpm (4.7 l/min) and 4 gpm (15.1 l/min) and a range of water supply pressures typically available from the common fluid supply to a user (e.g., about 20-80 psi (about 137.9-551.6 kPa) from a municipal water supply or well) to supply input fluid to both the water pump and the secondary fluid inlet 1130 of the jet pump 1100. The jet pump 1100 was designed with a target high flow mode performance level of 4.5 gpm (17 l/min) to provide a reasonable factor of safety to achieve the minimum acceptable performance level for the high flow operating mode. In one embodiment, the jet pump 1100 is paired with a water pump having a capacity of 2.7 gpm (10.2 l/min) at 3000 psi (20.68 MPa) (though water pumps of similar capacities will yield similar results from the jet pump). Using these targets, a flow ratio ("M") for the high flow operating mode was calculated by comparing the flow rate into the secondary fluid inlet 1130 ("$Q_2$") to the flow rate into the primary fluid inlet 1105 ("$Q_1$") according to the following equation.

$$M = \frac{Q_2}{Q_1}$$

The water pump supplies 2.7 gpm (10.2 l/min) as primary flow $Q_1$ and the jet pump 1100 needs to provide sufficient secondary flow $Q_2$ to provide the target high flow mode performance level of 4.5 gpm (17.0 l/min) output from the jet pump, which leads to a target secondary $Q_2$ of 1.8 gpm (6.8 l/min) and a flow ratio of 2/3.

A nozzle to mixing conduit diameter ratio is used with other parameters to relate the flow ratio to a pressure ratio. The nozzle to mixing conduit diameter ratio ("R") is calculated by comparing the outer diameter ("$D_n$") at the exit end of the nozzle to the minimum inner diameter ("$D_m$") of the mixing portion of the mixing conduit 1140 according to the following equation.

$$R = \left(\frac{D_n}{D_m}\right)^2$$

The pressure ratio ("N") is calculated by comparing the outlet pressure at the primary fluid outlet 1125 ("$P_5$"), the secondary inlet pressure at the secondary fluid inlet 1130 ("$P_2$"), and the primary inlet pressure at the primary fluid inlet 1105 ("$P_1$") according to the following equation.

$$N = \frac{P_5 - P_2}{P_1 - P_5}$$

Flow ratio, nozzle to mixing conduit diameter ratio, and pressure ratio are related according to the following equation, where C is density ratio, Km is mixing conduit loss, Kd is diffuser loss, Ks is secondary flow inlet loss, Kp is primary nozzle loss.

$$N = \frac{2R + \frac{2CM^2R^2}{1-R} - R^2(1+CM)(1+M)(1+K_m+K_d) - \frac{CM^2R^2}{(1-R)^2}(1+K_s)}{(1+K_p) - 2R - \frac{2CM^2R^2}{1-R} + R^2(1+CM)(1+M)(1+K_m+K_d)}$$

Figure 23:
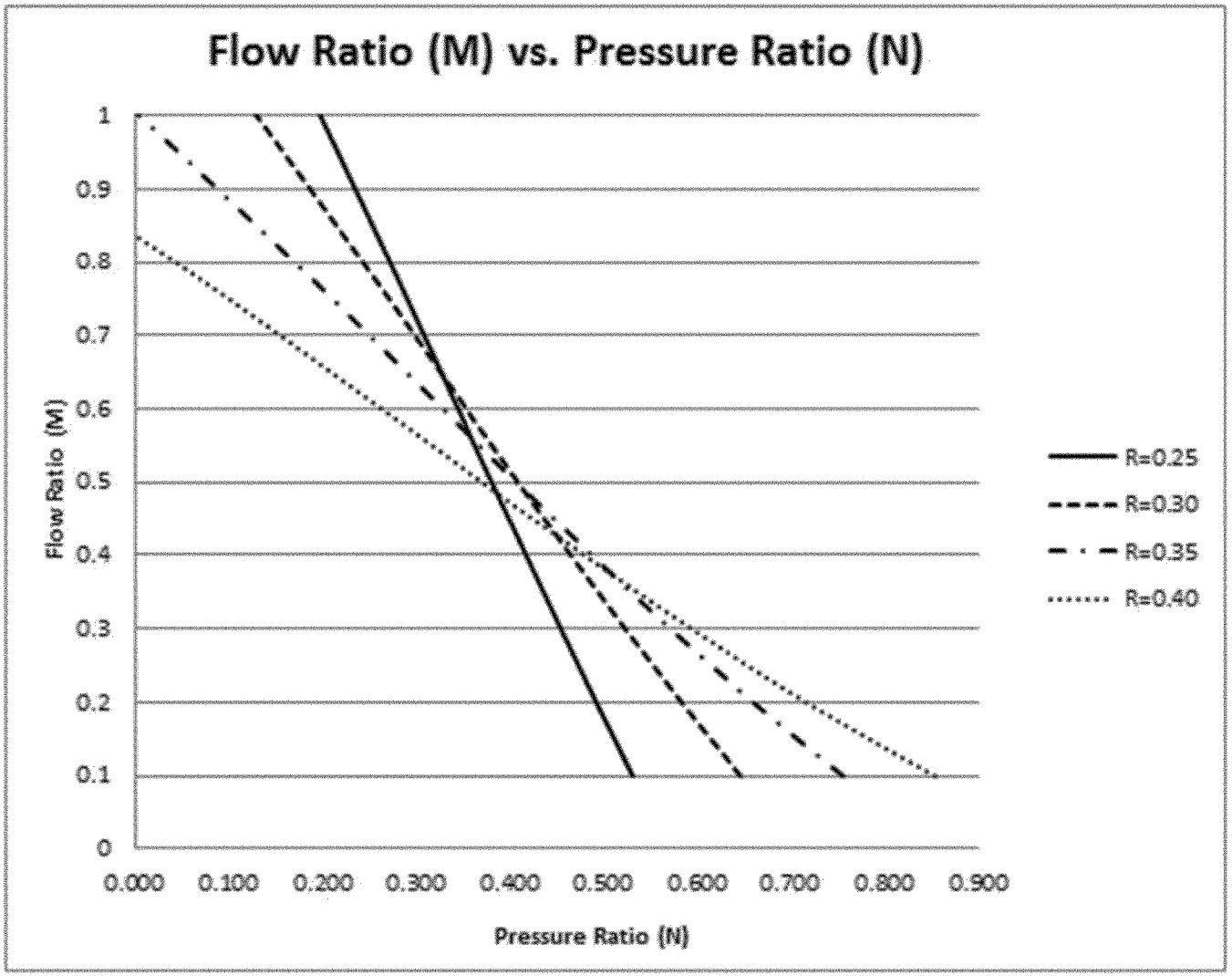
FIG. 23 is a graph plotting flow ratio versus pressure ratio for various values of nozeel to mixing conduit diameter ratio.

In view of this relationship, Applicant determined that the optimal range of pressure ratios to meet the target flow ratio of 2/3 is between about 0.15 and 0.55, with a pressure ratio of about 0.3 preferred, and that the optimal nozzle to mixing conduit diameter ratio is between about 0.2 and 0.5, with a nozzle to mixing conduit diameter ratio of about 0.3 preferred. The relationships between flow ratio, pressure ratio, and nozzle to mixing conduit diameter ratio are graphed in FIG. 23. The pressure ratio of 0.3 reliably provides the target flow ratio even when the primary inlet pressure $P_1$ and the secondary inlet pressure $P_2$ vary, as may occur during normal operation of a specific pump or as may occur with the inlet pressure provided by pumps of different output capacities. As the pressure ratio approaches 0.1 and below, the required primary inlet pressure $P_1$ to meet the target flow ratio becomes too high to be provided by a water pump suitable in performance and price for use with a consumer or residential pressure washer. As the pressure ratio approaches 0.5 and above, the output flow rate from the jet pump is reduced to such an amount that the performance of the "high flow operating mode" is not of a high enough flow rate to be considered "high flow" by the user—that is the jet pump is not providing sufficient flow multiplication to truly provide a high flow operating mode. The optimal range of pressure ratios to meet the target flow ratio is between about 0.15-0.55, with a pressure ratio of about 0.3 preferred, also functions to keep the pressure drop across the jet pump at no more than 500 psi (3.447 MPa) when operating in the high pressure mode. This ensures that the high pressure operating mode performance is comparable to the performance of a standard single operating mode pressure washer and meets the expectations of the pressure washer user for the high pressure operating mode.

Applicant discovered that specific positioning of the exit end of the nozzle relative to the entrance end of the mixing conduit had unexpected advantageous effects on how the flow ratio varies in response to changes in back pressure on the jet pump (i.e., outlet pressure $P_5$). The distance between the exit end of the nozzle relative and the entrance end of the mixing conduit ("X") is measured with the value of X being positive when the exit end of the nozzle is positioned within the mixing conduit as shown in FIG. 22. Applicant discovered that as X increases (becomes more positive), the flow ratio stays relatively consistent even as outlet pressure $P_5$ varies. For the pressure washers discussed above in which there are multiple nozzles that create different spray patterns or other functionalities (e.g., chemical inject) each causing different back pressures on the jet pump, all of which are exceed the threshold to produce the high flow operating mode, this means that the flow multiplication or boost provided by the jet pump is substantially similar for each of the nozzles so that there is less variation in output flow performance when using different high flow mode nozzles. In a preferred embodiment, the distance X is equal to the mixing conduit diameter $D_m$. This relationship optimizes the unexpected advantages discussed above for at least one embodiment of the jet pump and Applicant believes that this relationship may provide similar advantages for embodiments of a jet pump having different geometries than those tested by the Applicant.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A pressure washer comprising:

a pump for pressurizing a primary fluid flow, the pump including a pump inlet for receiving fluid from a common fluid source and a pump outlet for supplying a pressurized primary fluid; and a jet pump including a primary fluid inlet fluidly coupled to the pump outlet, a secondary fluid inlet configured to receive fluid from the common fluid source, and a fluid outlet; and wherein a high pressure operating mode, all of the pressurized primary fluid flows through the jet pump and exits through the fluid outlet of the jet pump;

wherein a high flow operating mode, all the pressurized primary fluid flows through the jet pump and entrains a secondary fluid supplied through the secondary fluid inlet from the common fluid source so that the secondary fluid also flows through the jet pump, resulting in a combined fluid flow of the primary fluid and the secondary fluid that exits through the fluid outlet of the jet pump;

wherein, in the high flow operating mode: a pressure ratio comparing a difference between an outlet pressure at the fluid outlet and a secondary inlet pressure at the secondary fluid inlet and a difference between a primary inlet pressure at the primary fluid inlet and the outlet pressure at the fluid outlet has a value of at least 0.15 and not greater than 0.55; and wherein, in the high flow operating mode: a flow ratio comparing a secondary flow rate of the secondary fluid supplied through the secondary fluid inlet and a primary flow rate of primary pressurized fluid supplied through the primary fluid inlet has a target value of 2/3.

2. The pressure washer of claim 1, wherein the jet pump further comprises:

a nozzle having an external nozzle diameter at an exit end of the nozzle; and a mixing conduit having an internal mixing passage diameter, wherein the external nozzle diameter to the internal mixing passage diameter ratio has a value of at least 0.2 and not greater than 0.5.

3. The pressure washer of claim 2, wherein the mixing conduit includes an entrance end providing access to a mixing passage and the nozzle extends into the mixing passage.

4. The pressure washer of claim 3, wherein the exit end of the nozzle is spaced apart from the entrance end of the mixing conduit by a distance substantially equal to the internal mixing passage diameter of the mixing passage.

5. The pressure washer of claim 4, wherein the high pressure operating mode, a pressure difference between the primary inlet pressure at the primary fluid inlet and the outlet pressure at the fluid outlet does not exceed 500 pounds per square inch; and wherein in the high flow operating mode, a fluid flow rate from the fluid outlet of the jet pump is at least 3 gallons per minute at the outlet pressure of at least 100 pounds per square inch.

6. The pressure washer of claim 1, wherein the jet pump further comprises:

a nozzle having an exit end; and a mixing conduit having an entrance end providing access to a mixing passage, wherein the nozzle extends into the mixing passage.

7. The pressure washer of claim 6, wherein the mixing passage has an internal mixing passage diameter and the exit end of the nozzle is spaced apart from the entrance end of the mixing conduit by a distance substantially equal to the internal mixing passage diameter of the mixing passage.

8. The pressure washer of claim 1, wherein the high pressure operating mode, a pressure difference between a primary inlet pressure at the primary fluid inlet and an outlet pressure at the fluid outlet does not exceed 500 pounds per square inch; and wherein in the high flow operating mode, a fluid flow rate from the fluid outlet to the jet pump is at least 3 gallons per minute at the outlet pressure of at least 100 pounds per square inch.

9. The pressure washer of claim 1, wherein the pressure washer does not include a bypass conduit to allow at least a partial flow of the pressurized primary fluid to bypass at least a portion of the jet pump.

10. A pressure washer comprising:

a pump for pressurizing a primary fluid flow, the pump including a pump inlet for receiving fluid from a common fluid source and a pump outlet for supplying a pressurized primary fluid; and a jet pump comprising:

a primary fluid inlet fluidly coupled to the pump outlet;

a secondary fluid inlet configured to receive fluid from the common fluid source;

a nozzle having an external nozzle diameter at an exit end of the nozzle;

a mixing conduit having an internal mixing passage diameter, wherein the external nozzle diameter to the internal mixing passage diameter ratio has a value of at least 0.2 and not greater than 0.5; and a fluid outlet;

wherein a high pressure operating mode, all of the pressurized primary fluid flows through the jet pump and exits through the fluid outlet of the jet pump;

wherein a high flow operating mode, all the pressurized primary fluid flows through the jet pump and entrains a secondary fluid supplied through the secondary fluid inlet from the common fluid source so that the secondary fluid also flows through the jet pump, resulting in a combined fluid flow of the primary fluid and the secondary fluid that exits through the fluid outlet of the jet pump; and wherein, in the high flow operating mode: a flow ratio comparing a secondary flow rate of the secondary fluid supplied through the secondary fluid inlet and a primary flow rate of primary pressurized fluid supplied through the primary fluid inlet has a target value of 2/3.

11. The pressure washer of claim 10, wherein the mixing conduit includes an entrance end providing access to a mixing passage and the nozzle extends into the mixing passage.

12. The pressure washer of claim 11, wherein the exit end of the nozzle is spaced apart from the entrance end of the mixing conduit by a distance substantially equal to the internal mixing passage diameter of the mixing passage.

13. The pressure washer of claim 10, wherein the high pressure operating mode, a pressure difference between a primary inlet pressure at the primary fluid inlet and the outlet pressure at the fluid outlet does not exceed 500 pounds per square inch; and wherein in the high flow operating mode, a fluid flow rate from the fluid outlet of the jet pump is at least 3 gallons per minute at the outlet pressure of at least 100 pounds per square inch.

14. The pressure washer of claim 10, wherein the pressure washer does not include a bypass conduit to allow at least a partial flow of the pressurized primary fluid to bypass at least a portion of the jet pump.

15. A pressure washer comprising:

a pump for pressurizing a primary fluid flow, the pump including a pump inlet for receiving fluid from a common fluid source and a pump outlet for supplying a pressurized primary fluid; and a jet pump comprising:

a primary fluid inlet fluidly coupled to the pump outlet;

a secondary fluid inlet configured to receive fluid from the common fluid source;

a mixing conduit having an internal mixing passage diameter and an entrance end providing access to a mixing passage;

a nozzle having an external nozzle diameter at an exit end of the nozzle, wherein the nozzle extends into the mixing passage; and a fluid outlet;

wherein the exit end of the nozzle is spaced apart from the entrance end of the mixing conduit by a distance substantially equal to the internal mixing passage diameter of the mixing passage;

wherein a high pressure operating mode, all of the pressurized primary fluid flows through the jet pump and exits through the fluid outlet of the jet pump;

wherein a high flow operating mode, all the pressurized primary fluid flows through the jet pump and entrains a secondary fluid supplied through the secondary fluid inlet from the common fluid source so that the secondary fluid also flows through the jet pump, resulting in a combined fluid flow of the primary fluid and the secondary fluid that exits through the fluid outlet of the jet pump; and wherein, in the high flow operating mode: a flow ratio comparing a secondary flow rate of the secondary fluid supplied through the secondary fluid inlet and a primary flow rate of primary pressurized fluid supplied through the primary fluid inlet has a target value of 2/3.

16. The pressure washer of claim 15, wherein the high pressure operating mode, a pressure difference between a primary inlet pressure at the primary fluid inlet and an outlet pressure at the fluid outlet does not exceed 500 pounds per square inch; and wherein in the high flow operating mode, a fluid flow rate from the fluid outlet of the jet pump is at least 3 gallons per minute at the outlet pressure of at least 100 pounds per square inch.

17. The pressure washer of claim 15, wherein the pressure washer does not include a bypass conduit to allow at least a partial flow of the pressurized primary fluid to bypass at least a portion of the jet pump.

* * * * *